United States Patent [19]

Kinoshita et al.

[11] Patent Number: 4,866,474

[45] Date of Patent: Sep. 12, 1989

[54] COPYING APPARATUS CAPABLE OF FORMING A COMPOSITE IMAGE OF AN OUTLINE IMAGE AND A NORMAL IMAGE

[75] Inventors: Naoyoshi Kinoshita; Toshikazu Higashi; Yasuyuki Matsuuchi; Yoshihiko Hatta; Masazumi Ito, all of Osaka, Japan

[73] Assignee: Minolta Camera Kabushiki Kaisha, Osaka, Japan

[21] Appl. No.: 147,323

[22] Filed: Jan. 22, 1988

[30] Foreign Application Priority Data

Jan. 23, 1987 [JP] Japan ..... 62-14760
Jan. 28, 1987 [JP] Japan ..... 62-17543
Jan. 28, 1987 [JP] Japan ..... 62-17544

[51] Int. Cl.[4] ..... G03G 15/01; G03G 15/22; G03G 21/00

[52] U.S. Cl. ..... 355/218; 355/225; 355/309; 355/328

[58] Field of Search ..... 355/3 R, 3 CH, 4, 7, 355/14 R, 14 CH

[56] References Cited

U.S. PATENT DOCUMENTS

| | | | |
|---|---|---|---|
| 3,572,288 | 8/1968 | Turner | 118/637 |
| 3,914,043 | 10/1975 | McVeigh | 355/4 |
| 3,960,445 | 6/1976 | Drawe | 355/4 |
| 3,967,891 | 7/1976 | Rippstein | 355/3 R |
| 4,346,982 | 8/1982 | Nakajima et al. | 355/3 R |
| 4,572,102 | 2/1986 | Yuge et al. | 118/689 |
| 4,579,443 | 4/1986 | Abuyama et al. | 355/4 |
| 4,627,707 | 12/1986 | Tani et al. | 355/14 R |
| 4,634,259 | 1/1987 | Oishi et al. | 355/4 |
| 4,657,376 | 4/1987 | Ide | 355/14 R |
| 4,720,730 | 1/1988 | Ito | 355/4 |
| 4,728,985 | 3/1988 | Nakashima et al. | 355/7 |
| 4,743,945 | 5/1988 | Ito et al. | 355/14 R X |
| 4,743,946 | 5/1988 | Nishimori et al. | 355/14 C |
| 4,745,437 | 5/1988 | Oka et al. | 355/14 CH |
| 4,772,921 | 9/1988 | Ito | 355/14 SH |

FOREIGN PATENT DOCUMENTS

| | | |
|---|---|---|
| DE3705511 | 9/1987 | Fed. Rep. of Germany . |
| 48-22212 | 7/1973 | Japan . |
| 51-134635 | 11/1976 | Japan . |
| 54-30833 | 3/1979 | Japan . |
| 60-170868 | 9/1985 | Japan . |
| 60-212778 | 10/1985 | Japan . |
| 61-72270 | 4/1986 | Japan . |
| 61-203474 | 9/1986 | Japan . |

*Primary Examiner*—Fred L. Braun
*Attorney, Agent, or Firm*—Burns, Doane, Swecker & Mathis

[57] ABSTRACT

Copying apparatus is provided in which outline copying for only a designated area of an original image can be easily selected. An area for the outline copying can be designated and images inside and outside the designated area can be copied in different colors. The arrangement includes a plurality of keys for designating an area of an original image to be copied and a scorotron charger for causing a potential in areas other than the outline portions of an electrostatic latent image, formed on a photoreceptor drum, to be substantially equal to a potential in an area containing the image. An eraser unit is provided for erasing the charge in an area where development is not required and a developing device develops the electrostatic latent image. A transfer charger is provided for transferring the image developed by the developing device onto copying paper. When an area of the original images designated and an outline image forming mode is selected by the operator of the machine, two copy operations are performed to composite an outlined image formed inside or outside the designated area and a normal image formed in the area which does not include the outline image so that a composite image is copied onto the copy paper.

34 Claims, 38 Drawing Sheets

COPYING APPARATUS CAPABLE OF FORMING A COMPOSITE IMAGE OF AN OUTLINE IMAGE AND A NORMAL IMAGE

BACKGROUND OF THE INVENTION

1. Field of the invention

The present invention relates to a copying apparatus and particularly to a copying apparatus capable of copying outlines of only an image inside or outside a designated area in a color identical to or different from the color in the other area.

2. Description of the Prior Art

Generally speaking, the peripheral outline of an image is in practice full of necessary information thereabout and represents sufficiently characterizing features of the given image, thus playing among others a most important role in the judgement of the image.

The so-called outline image means such as a peripheral outline which is picked up from a generally full and positive documentary image and is devoid of intermediate tones or, solid representation, thus being most effective for the identification of the image and for pattern recognition purpose thereof.

As an example, an attractive composite color image pattern can be obtained in such a manner as to form by execution of successive copying operations a black pattern encircled by a color outline.

On the other hand, there have been various proposals as copying apparatus capable of performing copy operation by designating an arbitrary area of an original image. One of those proposals is a copying apparatus capable of performing editing copy, for example, in a trimming mode for copying only an image within an area designated by a coordinate input method or the like, or in an erase mode for erasing only the image within the designated area.

Another proposal is a copying apparatus having a plurality of developer containers containing developers of different colors to obtain a copy in multiple colors by composite copy operation.

As for the above described outline copy for forming an image of an outline portion, it is requested not only to form an outline image for a complete image of an original (i.e., letters, characters, patterns or the like contained in the whole region of the original) but also to form an outline image for a designated area of the original.

In addition, it is sometimes requested to form an image of an outline portion in a color different from that of the image of the other area of the original.

SUMMARY OF THE INVENTION An object of the present invention is to provide a copying apparatus capable of performing outline copy for a specified portion of an original image. Another object of the present invention is to provide a copying apparatus capable of performing outline copy for only an image inside or outside a designated area of an original image region. A further object of the present invention is to provide a copying apparatus capable of performing outline copy for only an image inside or outside the designated area in a color different from that of the other area.

Briefly stated, the copying apparatus of the present invention comprises: an electrostatic latent image bearing member, first charging means for charging the electrostatic latent image bearing member, exposure means for applying an exposure of an original image to the electrostatic latent image bearing member to form an electrostatic latent image, second charging means for recharging the electrostatic latent image formed on the electrostatic latent image bearing member to form an electrostatic latent image of only outline portions thereof, developing means for developing the electrostatic latent images, and transfer means for transferring the developed image, the first charging means, the exposure means, the developing means and the transfer means being operated to form a first image, the first charging means, the exposure means, the second charging means, the developing means and the transfer means being operated to form a second image of only the outline portions of the original image, and the first image and the second image both being copied on the same face of copy paper. According to another aspect of the present invention, the copying apparatus comprises refeed means for containing copy paper where the first or second image has been formed and refeeding the copy paper to the transfer means. According to a further aspect of the present invention, the copying apparatus comprises first mode designation means for designating an outline image forming mode and area designation means for designating an area of the original image. Thus, when the outline image forming mode is designated and an area is designated, the first charging means, the exposure means, the developing means and the transfer means are operated to copy an image outside the designated area in a first copy operation and the first charging means, the exposure means, the second charging means, the developing means and the transfer means are operated to copy an image inside the designated area in a second copy operation. According to a still further aspect of the invention, the first charging means, the exposure means, the developing means and the transfer means are operated to copy an image inside the designated area in a first copy operation and the first charging means, the exposure means, the second charging means, the developing means and the transfer means are operated to copy an image outside the designated area in a second copy operation. According to a still further aspect of the invention, the first charging means, the exposure means, the second charging means, the developing means and the transfer means are operated to copy an image outside the designated area in a first copy operation and the first charging means, the exposure means, the developing means and the transfer means are operated to copy an image inside the designated area in a second operation. According to a still further aspect of the invention, the first charging means, the exposure means, the second charging means, the developing means and the transfer means are operated to copy an image inside the designated are in a first copy operation and the first charging means, the exposure means, the developing means and the transfer means are operated to copy an image outside the designated area in a second operation. According to a still further aspect of the invention, the copying apparatus comprises erasure means for erasing electric charge on the electrostatic latent image bearing member. According to a still further aspect of the present invention, the copying apparatus comprises means for designating a trimming mode to cause only an image inside a designated area to be a visible image and when the outline image forming mode and the trimming mode are designated and an area is designated, electric charge outside the designated are is erased to recharge a latent image corresponding to the image inside the designated area in one copy operation, so that an outline image is formed only inside the designated area. According to a still further aspect of the present invention, the copying apparatus comprises means for designating an erase mode to cause only an image outside a designated area to be a visible image and when the outline image forming mode and the erase mode are designated and an area is designated, electric charge inside the designated area is erased to recharge a latent image corresponding to the image outside the designated area in one copy operation, so that an outline image is formed only outside the designated area. According to a still further aspect of the present invention, the copying apparatus comprises first and second developing devices, so that an image inside a designated area and an image outside the designated area are caused to be visible images in different colors. According to a still further aspect of the present invention, predetermined voltages are applied from a first power supply to the first and second developing devices and the second charging means includes a grid of a scorotron charger and a second power supply as a unit, the second charging means being able to be mounted in the apparatus in place of the first developing device. When the second charging means is mounted in place of the first developing device, the first power supply and the second power supply cooperate to set a voltage higher than the voltage applied from the first power supply to the first developing device and lower than the voltage applied from the second power supply to the grid.

According to the present invention, outline copy for only a designated area of an original image can be easily effected. In addition, an area for outline copy can be designated and images inside and outside the designated area can be copied in different colors. Thus, the copying apparatus of the present invention is very convenient to the user. Furthermore, when the second charging means is mounted in place of the first developing device, the voltage applied to the second developing device is set to a value higher than the voltage applied when the first developing device is mounted and lower than the voltage applied to the grid of the second charging means and, accordingly, only a power supply enabling standard copy is required in the main body of the copying apparatus, a special power supply for outline copy being not required. Consequently, an increase in the cost of the apparatus can be avoided.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
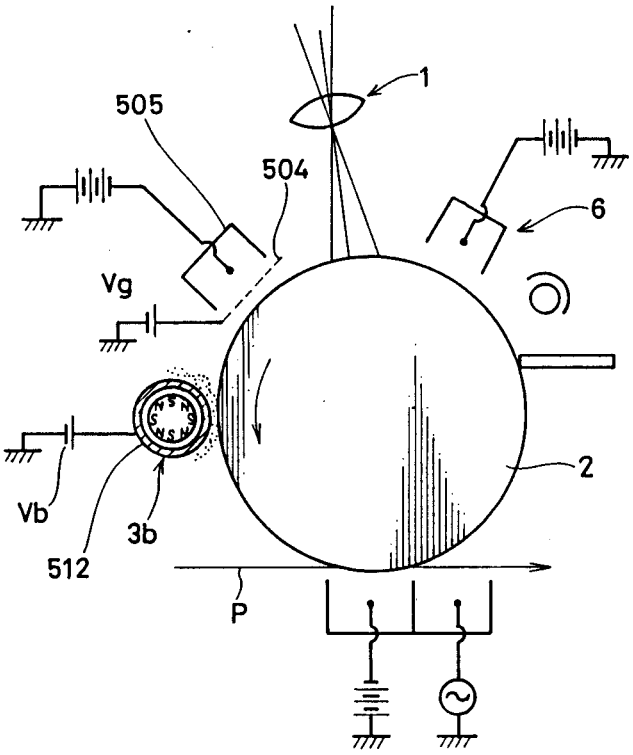
FIG. 1 is an illustration showing a construction of a copying apparatus capable of performing outline copy according to the present invention.
Figure 2:
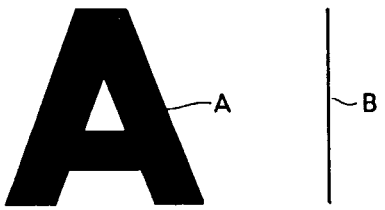
FIG. 2 is an illustration showing an image of an original.
Figure 3:
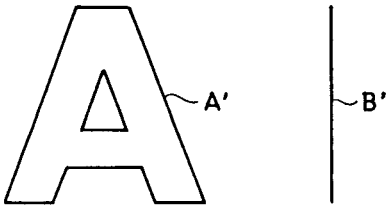
FIG. 3 is an illustration showing an outline image obtained by picking up only outlines from the image shown in FIG. 2.

Outline copy operation can be performed by using a copying apparatus having a construction as shown in FIG. 1. The outline copy operation relates to formation of an outline image A' by picking up only outlines in the case of an image area A, and to reproduction of a line-shaped image B' in the case of a line-shaped image B, as shown in FIGS. 2 and 3. A principle of the outline copy operation will be described in the following.

Figure 4:
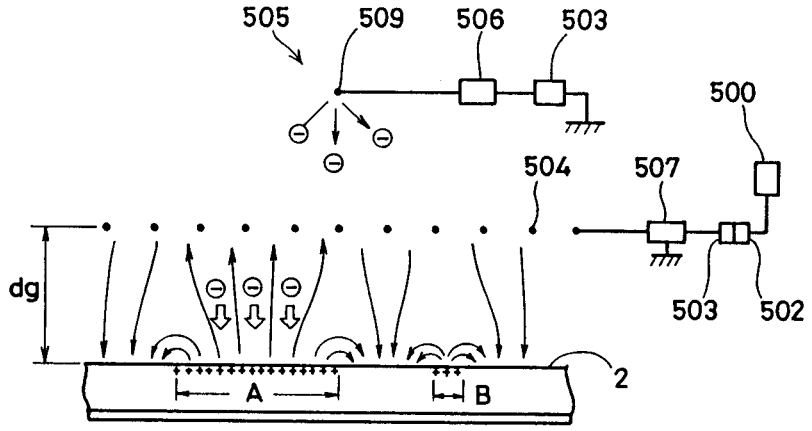
FIG. 4 is an illustration showing electric field between a scorotron charger and a photoreceptor drum.
Figure 5A:
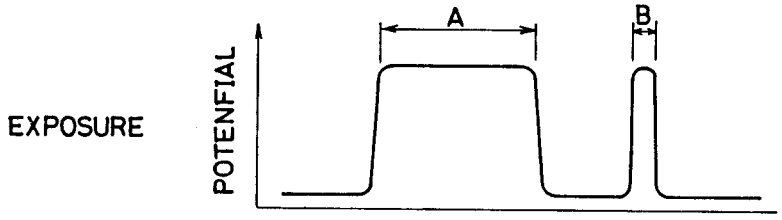
FIGS. 5A, 5B and 5C are diagrams showing potential changes on a surface of the photoreceptor drum.
Figure 5B:
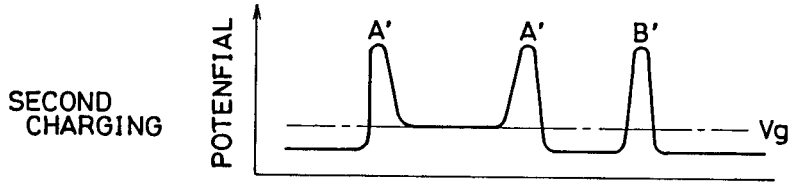
Figure 5C:
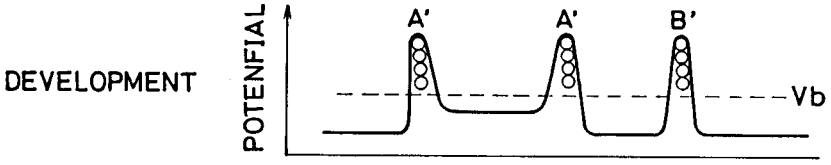

FIG. 4 is an illustration for explaining electric field between a scorotron charger 505 and a photoreceptor drum 2 and FIGS. 5A, 5B and 5C are diagrams showing changes in potential on a surface of the photoreceptor drum 2.

A high voltage of +5.5 kV is applied from a corona charger 6 to the surface of the photoreceptor drum 2, so that the surface is uniformly charged at a potential of about +600 V.

Then, when the surface of the photoreceptor drum 2 is subjected to exposure from an optical system 1, electric charge in areas not containing any image (referred to hereinafter as non-image areas) flows out therefrom and the voltage in those areas becomes about +80 V. In FIG. 5A, portions A and B correspond to areas containing images (referred to hereinafter as image areas) and the other portions correspond to non-image areas.

Subsequently, a voltage of −6.0 kV is applied to a charge wire 509 of the scorotron charger 505 and a grid voltage Vg lower than the surface potential of the image areas A and B is applied to a grid 504 of the scorotron charger 505. The grid voltage Vg is about +150 V. As a result, as shown in FIG. 4, electric lines of force are directed in principle from the scorotron charger 505 to the photoreceptor drum 2, while in the relatively large image area A electric lines of force are directed reversely from the photorecepter drum 2 to the scorotron charger 505. Thus, negative electric charge from the charge wire 509 attains the image area A and the potential in this area A is lowered to about +150 V, with peripheral outline portions A' and the narrow image area B' being left at the high potential, as shown in FIG. 5B.

Subsequently, as shown in FIG. 5C, toner is supplied to high-potential portions A' and B' having the electrostatic latent images from a developer sleeve 512 of a developing device 3b opposed to the photoreceptor drum 2, a developing bias voltage Vb, e.g., +200 V, higher than the grid voltage Vg being applied to the developer sleeve 512. Then, the toner images are transferred to copy paper P, so that the outline image as shown in FIG. 3 is obtained.

Now, embodiments of the present invention based on the above described principle will be described hereinafter.

I.

FIRST EMBODIMENT

Total Construction of the Copying Apparatus:

First, the total construction of the copy apparatus of the first embodiment as well as copying operation thereof will be described mainly referring to FIG. 6.

The copying apparatus of this embodiment has: a lower portion including copy paper storing portions 42, 43, a paper feed portion and an intermediate tray unit A; a middle portion including an image forming portion such as a photoreceptor drum 2; and an upper portion including an optical system 1. A sheet of copy paper on which a first copy operation has been effected is transported to the intermediate tray unit A and refed therefrom, so that a duplex copy or a composite copy can be made.

The photoreceptor drum 2 is rotatable in the direction shown by an arrow a. Around the drum 2, there are provided a corona charger 6, an erasure unit 1040, an outline image forming unit 3a containing a scorotron charger 505, a developing device 3b of a magnetic brush type, a transfer charger 5a, a copy paper separation charger 5b, a cleaning device 4 of a blade type and an eraser lamp 7 along the direction of rotation of the drum. The photoreceptor drum 2 is uniformly charged by the corona charger 6 when it rotates in the direction of the arrow a, and it is subjected to exposure of an image from the optical system 1, whereby an electrostatic latent image is formed thereon. Electric charge in an area where development of the electrostatic latent image is no required (i.e., an area for edition such as erasure or trimming as explained later) is erased by the erasure unit 1040. As for the electrostatic latent image not erased, a potential of the image area excluding that of a peripheral outline portion thereof is caused to be substantially equal to the potential of the above mentioned area not requiring development, by means of the scorotron charger 505. Then, the peripheral outline portion of the latent image is subjected to development by the developing device 3b, so that a toner image is obtained.

The optical system 1 is capable of scanning an original in a direction shown by an arrow b, under a document table 16. The optical system 1 comprises an exposure lamp 10, movable mirrors 11a, 11b and 11c, a lens 12 and a fixed mirror 11d. The exposure lamp 10 and the movable mirror 11a are moved together in the direction of the arrow b at a speed V/m (m being a copying magnification) with respect to a rotation speed V of the photoreceptor drum 2 (constant irrespective of an equal magnification or a variable magnification). The movable mirrors 11*b* and 11*c* are moved together in the direction of the arrow b at a speed V/2 m.

The copy paper storing portions comprise an upper elevator-type storing portion 42 and a lower elevator-type storing portion 43. Either copy paper sheets in the storing portion 42 or copy paper sheets in the storing portion 43 are selectively fed one by one by rotation of a feed roller 18 or a feed roller 19 through delivery rollers 20 and 21 or delivery rollers 22 and 23, so as to be transported to timing rollers 13 through transport rollers.

The copy paper thus transported is temporarily stopped by the timing rollers 13 and then sent to a transfer position in synchronism with the image formed on the photoreceptor drum 2. Thus, the toner image is transferred on the copy paper by discharge of the transfer charger 5*a* and the copy paper is separated from the surface of the photoreceptor drum 2 by discharge of the separation charger 5*b*. Subsequently, the copy paper is fed to a fixing device 9 by means of a transport belt 8 including air suction means, so that the toner image is thermally fixed. Residual toner on the photoreceptor drum 2 after the transfer is removed by the cleaning device 4 and residual electric charge on the drum 2 is removed by irradiation of the eraser lamp 7, so that the photoreceptor drum 2 is ready for a subsequent copy operation.

A lever 41 for selecting a copy paper transport path is provided between transport rollers 14 adjacent to an outlet of the fixing device 9 and discharge rollers 15. If the copy paper is discharged without being subjected to any further step, the lever 41 is set in a position shown by chained lines in FIG. 6. Thus, the copy paper sent out from the fixing device 9 is discharged through the discharged rollers 15 onto a tray 36. On the other hand, if a second copy operation such as the duplex copy or the composite copy is to be effected, the lever 41 is set in a position shown by solid lines, so that the copy paper is fed into the intermediate tray unit A by means of a guide plate 37 from the transport rollers 35.

The intermediate tray unit A comprises a transport path selection block, a transport block, a reversal block, an alignment tray block and a refeed block, those blocks being integrally formed as a unit.

The transport path selection block has transport rollers 50, 51 and a selection lever 59 pivotable about an axis 85 as a supporting point. The transport path selection block may be provided in the main body of the copying apparatus, not in the intermediate tray unit A. The reversal block has a reversing guide, whereby the copy paper transported to the reversal block is turned reversely and sent to an intermediate tray 58. The alignment tray block has the intermediate tray 58, a slide rail, a slide member and a regulator plate, whereby the sheets of copy paper sent to the intermediate tray 58 are aligned.

The refeed block has a holder, a refeed roller 38, delivery rollers 39 and 40, and a guide plate, whereby the sheets of copy paper aligned on the intermediate tray 58 are refed one by one.

Figure 6:
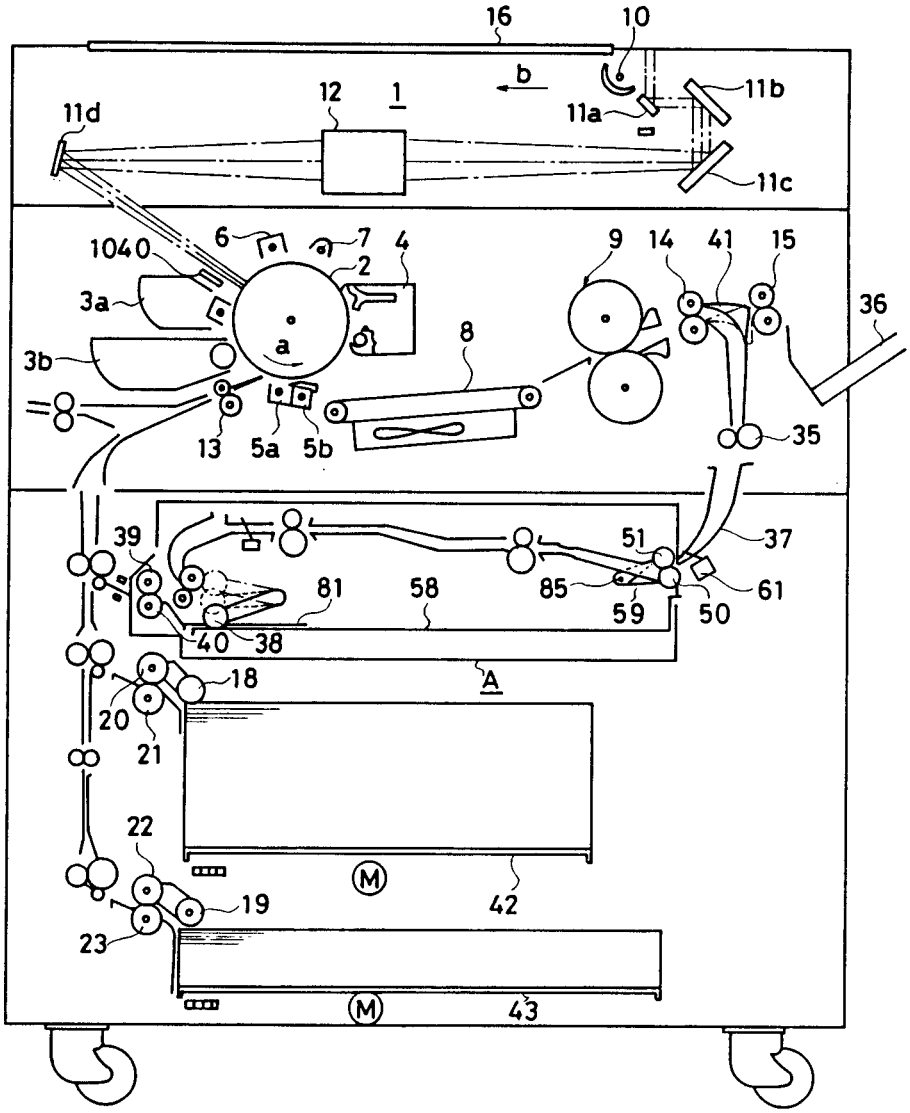
FIG. 6 is a view showing a total construction of a copying apparatus of a first or second embodiment of the present invention.

When a duplex copy mode or a composite copy mode is selected by pressing a mode selection key 303 or 304 on an operation panel 9 (shown in FIG. 7), the selection lever 41 is turned to the position shown by the solid lines in FIG. 6, so that the copy paper with one face or a portion thereof already subjected to a copy process is drawn by the guide plate 37 from the transport rollers 35 so as to be transported to the transport rollers 50 and 51.

In the duplex mode, the selection lever 59 is set in the position shown by the solid lines in FIG. 6 and the copy paper is guided on the upper surface of the lever 59 and transported to the transport block. Then, the copy paper with the face already subjected to the copy process being turned upward is sent onto the intermediate tray 58 through the reversal block. The sheets of the copy paper thus transported are aligned on the intermediate tray 58 and they are refed one by one by a clockwise rotation of the refeed roller 38.

On the other hand, in the composite mode, the selection lever 59 is set in the position shown by the chained lines in FIG. 6 and the copy paper passing through the transport rollers 50 and 51 is guided along the lower surface of the lever 59 and is directly transported onto the intermediate tray 58 with the face already subjected to the copy process being directed downward. The copy paper sheets thus transported are aligned on the intermediated tray 58 and then they are refed one by one by the clockwise rotation of the refeed roller 38.

The copy paper to be refed is delivered by the delivery rollers 39 and 40 and transported to the timing rollers 13 through the transport rollers. Then, a second copy process in the duplex mode or the composite mode is applied to the copy paper in the same manner as in a standard copy process. The refeed roller 38 can be set in any of three positions (as shown in FIG. 6 by chained lines, dotted lines and solid lines) so as to be driven. When the copy paper is transported on the intermediate tray 58, the refeed roller 38 is set in the upper or middle position and presses appropriately on the copy paper sheets aligned on the intermediate tray 58 at the time of refeeding.

Description of the Operation Panel:

Keys and display elements on the operation panel will be described.

Figure 7:
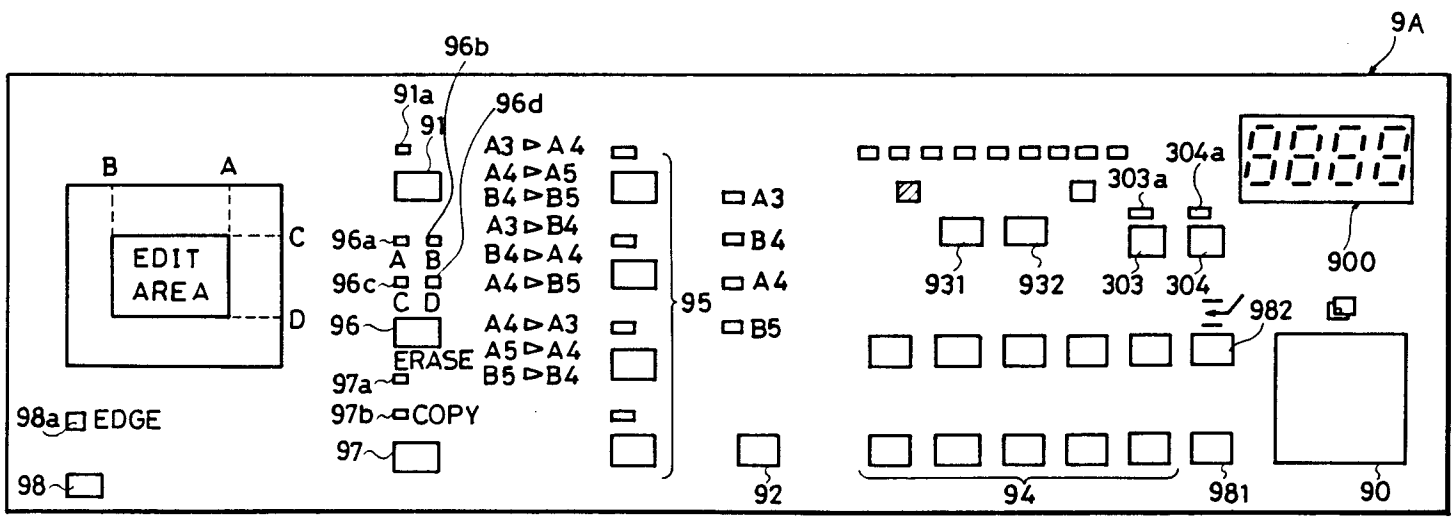
FIG. 7 is a plan view of an operation panel of the copying apparatus shown in FIG. 6.

FIG. 7 is a plan view of the operation panel 9A of the above described copying apparatus.

As shown in FIG. 7, the operation panel 9A includes: a print key 90 for starting copy operation; an edit copy select key (a copy mode selection key) 91 for switching between the standard copy mode and the edit copy mode; a copy paper selection key 92 for selecting copy paper sheets stored in the copy paper storing portion 42 or 43; an up key 932 and a down key 931 for changing a copy density; a ten key group 94 (having ten keys corresponding to numerals 1 to 9 and 0) for inputting a number of copies and numerical values of coordinate data; a magnification setting key group 95 for calling a preset copying magnification; a coordinate select key (a coordinate display key) 96 for displaying the coordinate data on the display panel 900 in the order of A, B, C and D; an erase/trimming switching key (an erasure area selection key) 97 for switching between the erase mode and the trimming mode; a clear stop key 981; an interruption key 982; an outline mode key 98 for designating an outline image forming mode; a duplex mode key 303 for designating a duplex mode; a composite mode key 304 for designating a composite mode; and the display panel 900 for displaying the number of copies or the coordinate data by illumination of segments. Small rectangles provided near the operation keys in FIG. 7 are LED elements for indicating that the corresponding keys are in an operation state.

Figure 8:
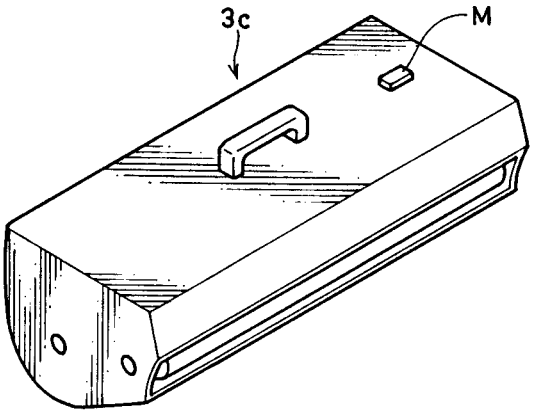
FIG. 8 is an external perspective view of a first developing device used in the copying apparatus shown in FIG. 6.
Figure 9:
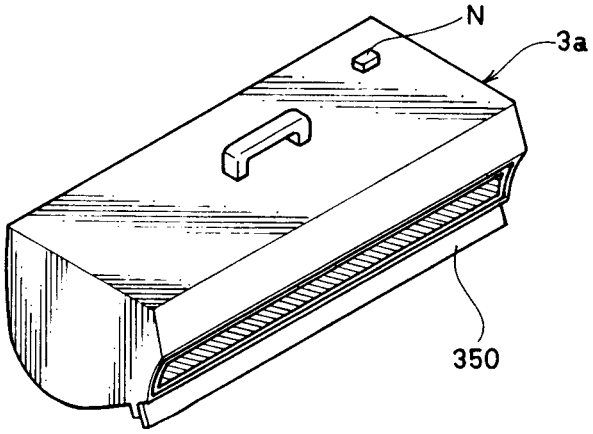
FIG. 9 is an external perspective view of an outline image forming unit used in the copying apparatus of FIG. 6.
Figure 10:
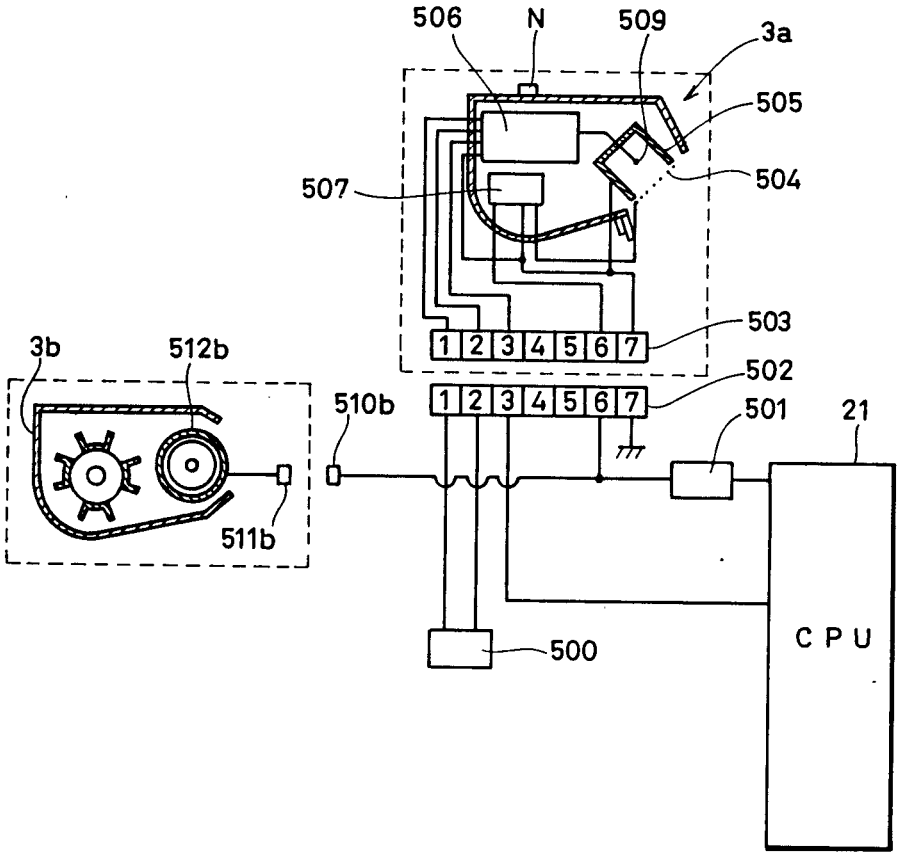
FIG. 10 is a circuit diagram showing connections of the outline image forming unit, a second developing device and a control CPU in the copying apparatus of FIG. 6.

Description of the Scorotron Charger:

FIG. 8 is a perspective view showing an external shape of a first developing device used in the present embodiment. FIG. 9 is a perspective view of an outline image forming unit containing the scorotron charger used in the present embodiment. FIG. 10 is a circuit diagram showing connections of the outline image forming unit, a second developing device and a CPU.

As can be seen from FIGS. 8 and 9, the first developing device 3c and the outline image forming unit 3a have almost the same external shape and they have interchangeability for setting in a position (as shown in FIG. 6) near the photoreceptor drum, above the second developing device 3b. In other words, the outline image forming unit 3a is set in the position of the first developing device 3c of the copying apparatus of this embodiment. In general, the copying apparatus uses the toner of two colors, red toner in the first developing device 3c and black toner in the second developing device 3b.

The CPU determines, dependent on an on or off state of a switch M (shown in FIG. 8) or a switch N (shown in FIG. 9), whether the first developing device 3c or the outline image forming unit 3a is set in the proper position of the copying apparatus.

As shown in FIG. 9, a seal member 350 is attached to a lower portion of the outline image forming unit 3a. This member 350 serves to cut off fine powder of toner from the second developing device 3b, thereby to prevent the inside of the outline image forming unit 3a from being soiled by such toner.

As shown in FIG. 10, the outline image forming unit 3a and the second developing device 3b are controlled by the CPU 21.

More specifically, a predetermined development bias voltage of +200 V is applied to a developer sleeve 512b of the second developing device 3b from a power supply 501 through connecters 510b and 511b.

A voltage of +150 V is applied to a grid 504 of the scorotron charger 505 from the power supply 501 through connecters 502, 503 and a distributor 507.

A voltage of DC+24 V is constantly supplied from a power supply 500 to a high-voltage power supply 506 for applying a high voltage of −6.0 kV to a charge wire 509.

Figure 11:
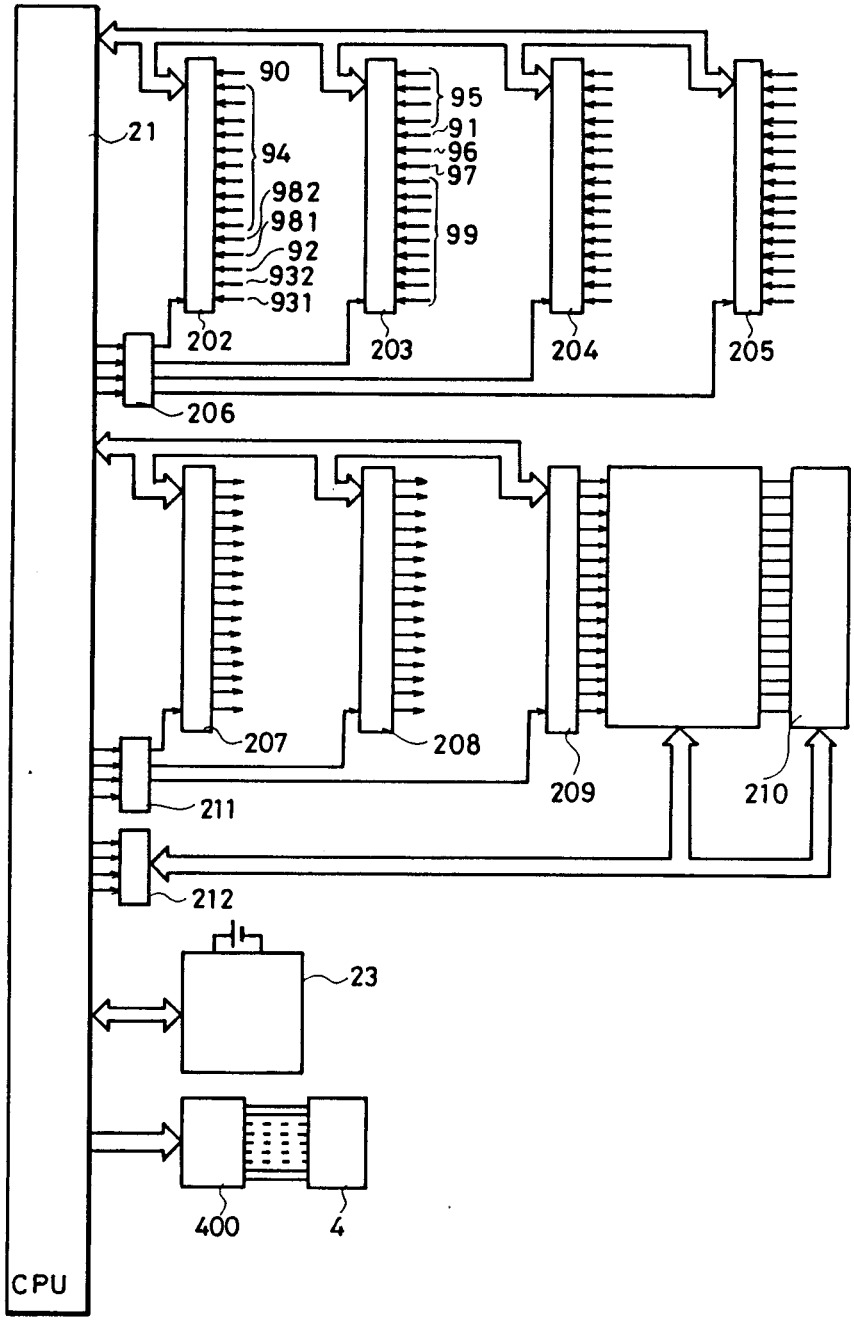
FIG. 11 is a diagram for explaining a construction of a control portion of the copying apparatus of FIG. 6.

Description of the Control Portion:

FIG. 11 is an illustration for explaining a construction of the control portion of the copying apparatus.

As shown in FIG. 11, the control portion comprises the CPU 21, a RAM 23 and other components. A driver 400 of the erasure unit 1040 is controlled by the CPU 21.

The CPU 21 is connected to input extension ICs 202 to 205 controlled through a decoder 206 and is further connected to the key groups of the operation panel 9A and sensor groups through the input extension ICs 202 and 205. The CPU 21 is also connected to drivers of the main motor, the developing motor, the timing roller clutch, the feed roller clutch, the corona charger, the transfer charger etc. through output extension ICs 207 to 209 controlled through a decoder 211. Further, the CPU 21 is connected to the on-display LED array 210 on the operation panel 9A.

Figure 12:
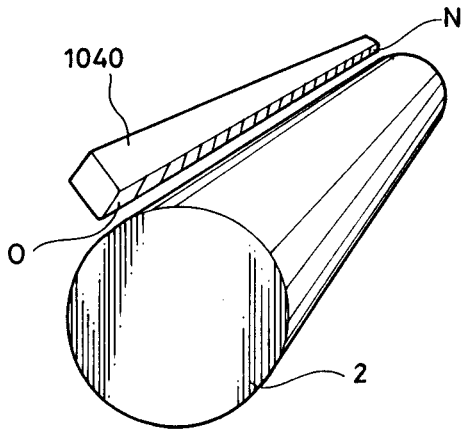
FIG. 12 is a perspective view of an erasure unit provided close to the photoreceptor drum.
Figure 13:
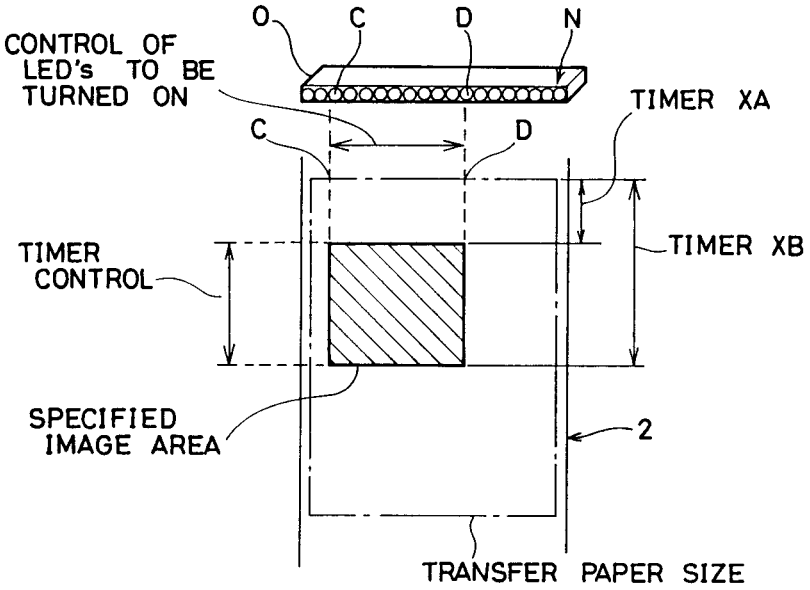
FIG. 13 is an illustration for explaining operation of the erasure unit for erasing electric charge on a designated area.

Description of the Erasure Unit:

FIG. 12 is a perspective view of the erasure unit 1040 located close to the photoreceptor drum 2. FIG. 13 is an illustration for explaining operation for erasing electric charge in a designated area by the erasure unit 1040.

As shown in FIGS. 12 and 13, the erasure unit 1040 includes an LED array composed of a large number of (N+1) LED elements provided in a row. When arbitrary LED elements are selectively turned on, electric charge in a corresponding area on the photoreceptor drum 2 is removed, thereby to prevent formation of an image in that area.

For example, as shown in FIG. 13, assuming that reference characters O to N are assigned to the N+1 LED elements in the order starting from the left one, and that the LED elements denoted by C to D are turned on in a period from an end of a timer XA to an end of a timer XB, electric charge in an area of the drum 2 corresponding to a hatched portion in FIG. 13 is removed and electrostatic latent image is not formed in that area. Accordingly, a copy image is not transferred in that area.

Figure 14:
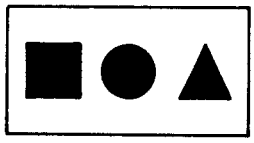
FIG. 14 shows an original image.
Figure 15A:
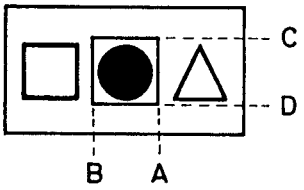
FIGS. 15A, 15B, 15C, 15D, 16A, 16B, 16C and 16D are illustrations for explaining an image forming method of the first or second embodiment.
Figure 16A:
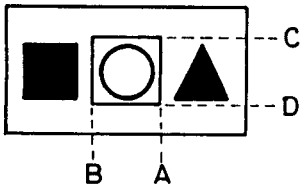

Description of the Image to be Copied:

FIG. 14 shows an original image and FIGS. 15A and 16A show examples of images copied by the apparatus of the present embodiment.

If an area ABCD enclosed by lines connecting points A, B, C and D is designated and the edit copy mode, the trimming mode and the outline image formine mode are selected, a copy image as shown in FIG. 15A is obtained. If the area ABCD is designated and the edit copy mode, the erase mode and the outline image forming mode are selected, a copy image as shown in FIG. 16A is obtained.

Description of the Operation:

The operation of the copying apparatus of the present embodiment will be described.

A.

MAIN ROUTINE

Figure 17:
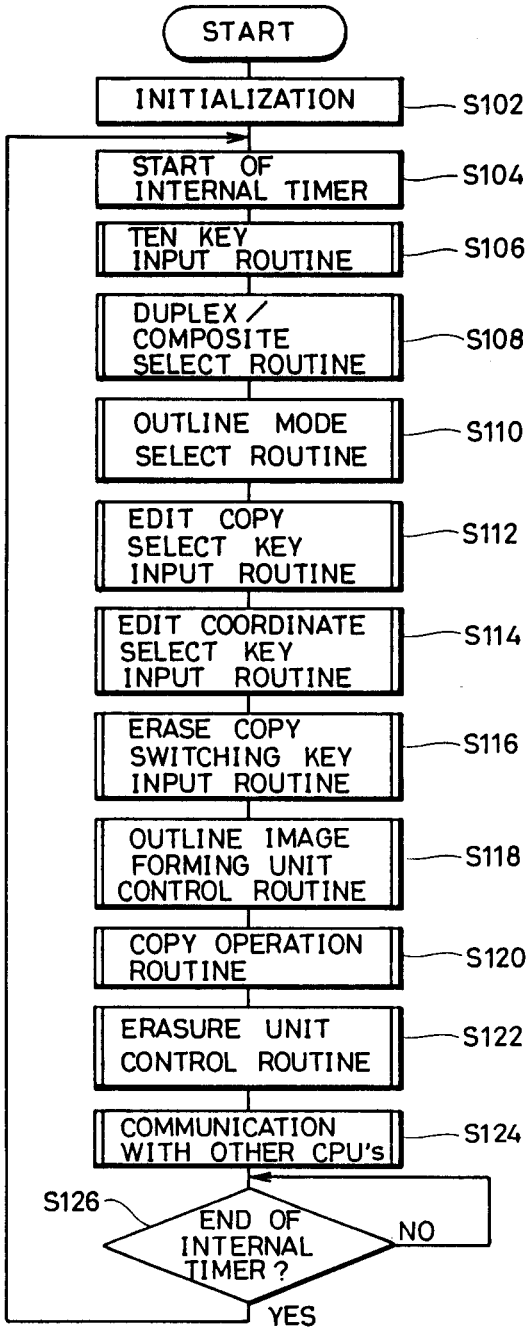
FIG. 17 is a flow chart showing processing in a CPU.

FIG. 17 is a flow chart showing a main routine of processing in the CPU 21.

The CPU 21 starts processing when a power supply is turned on, for example. First of all, initialization is effected (in the step S102). Then, a routine timer for defining a period of one routine is set (in the step S104).

Subsequently, subroutines in the steps S106 to S124 are executed. After that, the CPU 21 waits for an end of the routine timer (in the step S126) and then returns to the step S104 to repeat the processing. The subroutines in the respective steps to be described afterwards in detail are roughly indicated as follows.

(1) S106

This step relates to a subroutine for storing numerical values inputted by the ten key group 94 according to a selected mode (i.e., the edit copy mode or the standard copy mode). The edit copy mode includes the erase mode, the trimming mode, the outline image forming mode and the like, and requires input of coordinates.

(2) S108

This relates to a subroutine for setting the duplex copy mode or the composite copy mode in response to input through the operation keys 303, 304 and the like.

(3) S110

This step relates to a subroutine for setting the outline image forming mode or the like in response to input through the operation key 98.

(4) S112

This step relates to a subroutine for selection between the standard copy mode and the edit copy mode in response to input through the operation key 91.

(5) S114

This step relates to a subroutine for displaying coordinate data on condition that the edit copy mode is selected, in response to input through the operation key 96. More specifically, when the edit copy mode is set, coordinates data A, B, C and D are displayed in order on the display panel 900 responding to the operation of the edit coordinate select key 96.

(6) S116

This step relates to a subroutine for processing such as selection between the erase mode and the trimming mode on condition that the selected mode is the edit copy mode, in response to input through the operation key 97.

(7) S118

This step relates to a subroutine for controlling turn-on and turn-off of the outline image forming unit 3*b*.

(8) S120

This step relates to a subroutine for controlling copy operation of the copying apparatus, in response to input through the operation key 90.

(9) S122

This step relates to a subroutine for controlling turn-on and turn-off of the erasure unit 1040 to remove electric charge from an area not required to be developed.

(10) S124

This step relates to a subroutine for controlling communication with other CPUs such as a CPU for controlling the optical system 1 or a CPU for controlling a duplex/composite unit not shown.

B.

DESCRIPTION OF THE RESPECTIVE SUBROUTINES

The above mentioned respective subroutine steps will be described in detail.

Figure 18:
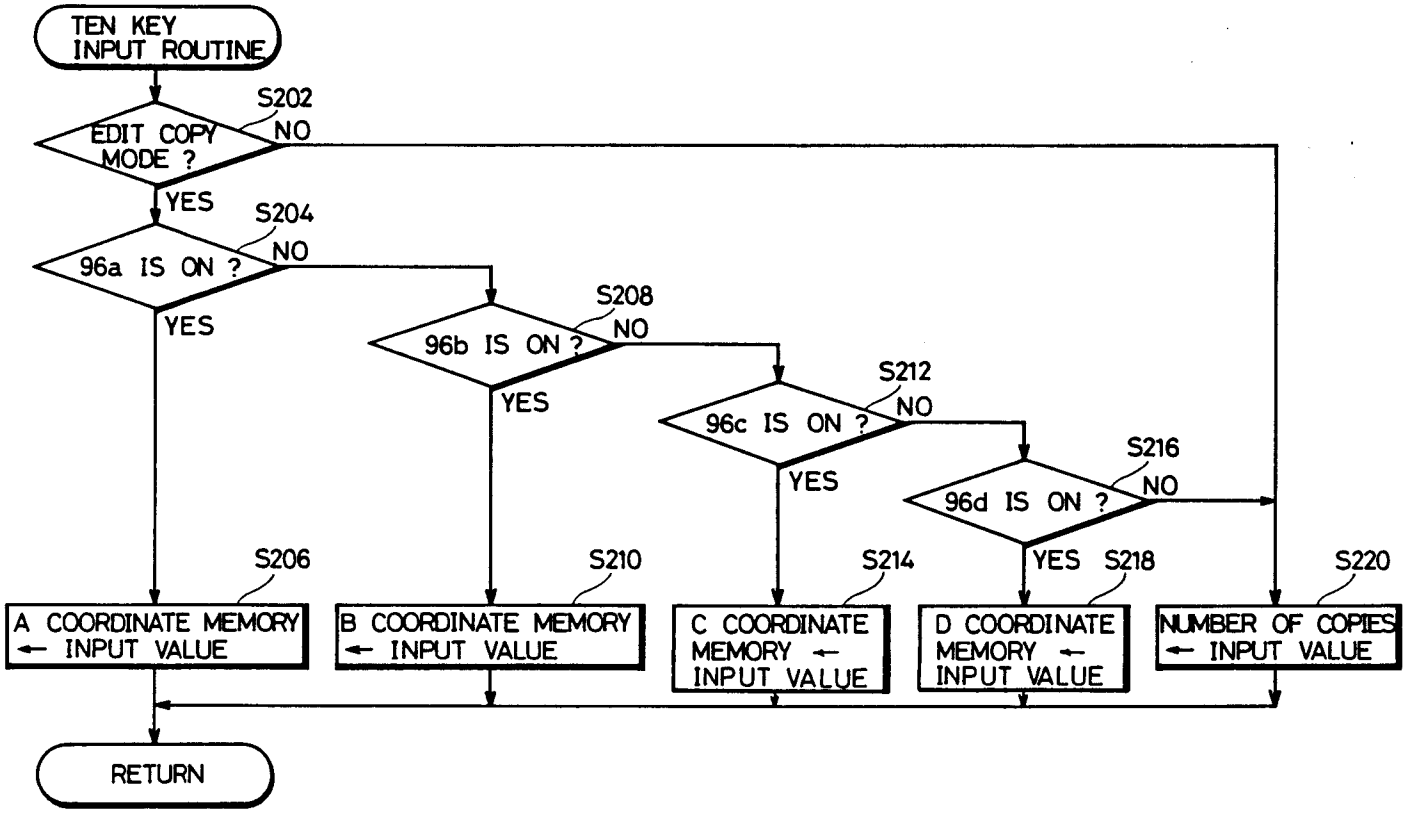
FIG. 18 is a flow chart showing details of a ten key group input routine.

FIG. 18 is a flow chart showing details of the step S106 concerning the subroutine for input through the ten key group.

First, in the step S202, it is determined whether the copy mode selected at present is the edit copy mode or the standard copy mode. This determination is made dependent on the on state or the off state of the edit copy mode display element 91*a*.

Figure 13A:
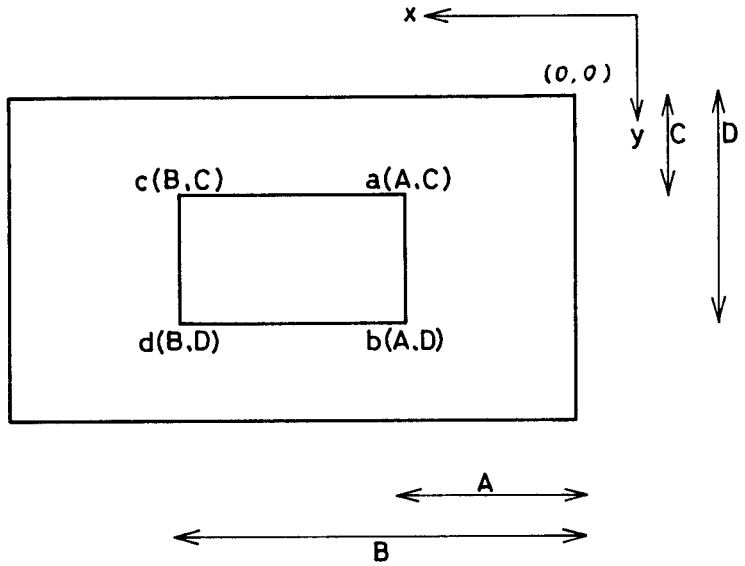
FIG. 13A is an illustration for explaining operation of defining a copy area or a erase area.

If the edit copy mode is selected, input of coordinate data is required as described above. In this case, the CPU 21 proceeds to the steps S204 to S218 to store input values through the ten key group 94 as coordinate data. More specifically, if the A coordinate display element 96*a* is in the on state (in the step S204), the input coordinate data is stored as A coordinate data (in the step S206). If the B coordinate display element 96*b* is in the on state (in the step S208), the input data is stored as B coordinate data (in the step S210). If the C coordinate display element 96*c* is in the on state (in the step S212), the input data is stored as C coordinate data (in the step S214). If the D coordinate display element 96*d* is in the on state (in the step S216), the input data is stored as D coordinate data (in the step S218). The four points a, b, c and d defining the copy area or the erase area are represented by coordinates (A, C), (A, D), (B, C), and (B, D), respectively (FIG. 13A). Supposing that the origin is at the upper right-hand corner of the copying paper, positive values for x are measured to the left of the x-axis extending leftward, and positive values for y are measured downward on the y-axis extending downward, A, B, C, and D are the x-coordinate of the points a and b, the x-coordinate of the points c and d, the y-coordinate of the points a and c, and the y-coordinate of the points b and d, respectively. In the copying machine, the copying paper advances in a direction corresponding to the negative direction of the x-axis, namely, the copying paper has a front edge on the right and advances rightward as viewed in FIG. 13A.

On the other hand, if it is determined in the step S202 that the standard copy mode is selected, the CPU 21 proceeds to the step S220 to store an input value through the ten key group 94 as the number of copies to be obtained.

Figure 19:
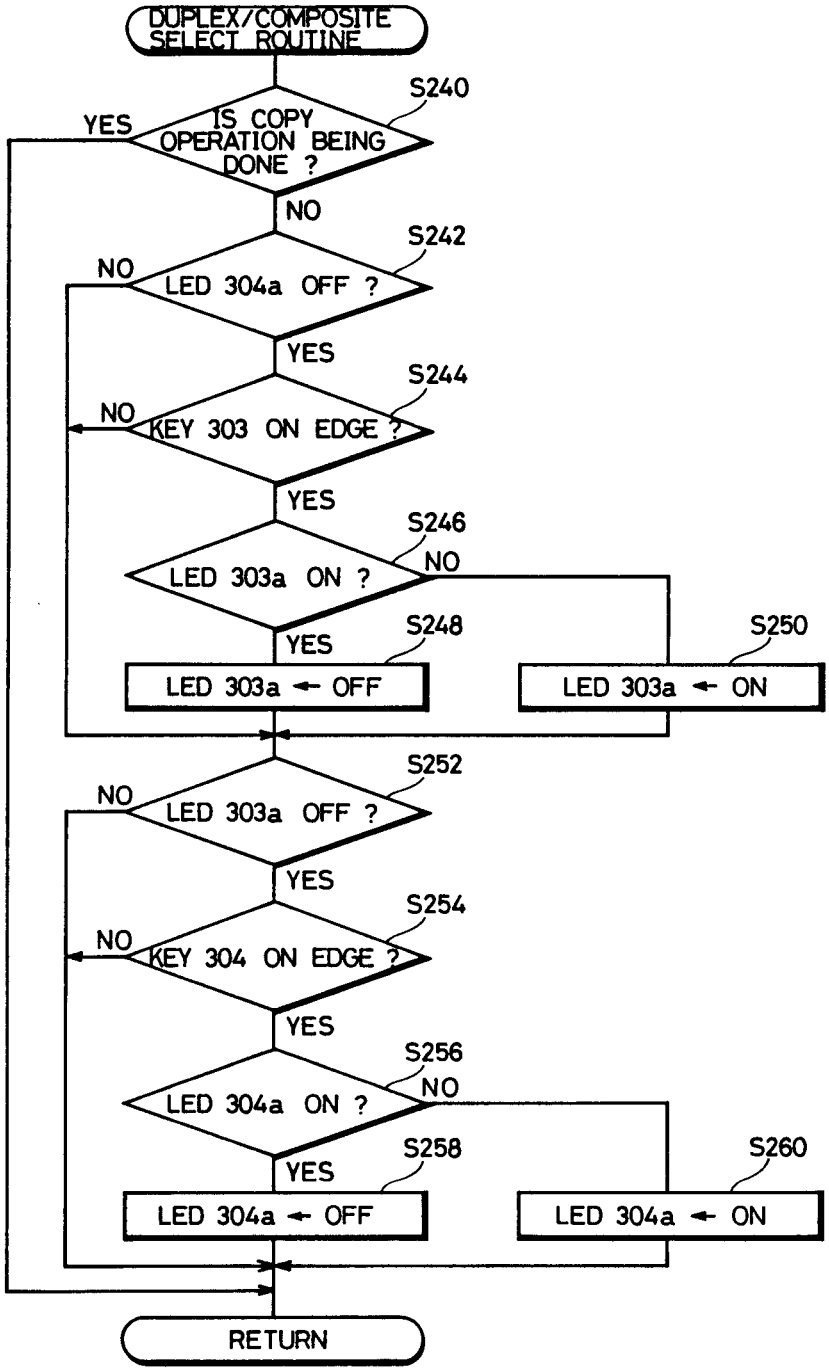
FIG. 19 is a flow chart showing details of a duplex composite copy selection routine.

FIG. 19 is a flow chart showing details of the step S108 concerning the subroutine for selection of the duplex or composite copy mode.

As shown in FIG. 19, on condition that copy operation is not being effected (in the step S240), and if it is determined that the composite copy mode is not selected (in the step S242) and that the duplex mode key 303 is operated (in the step S244), the duplex copy mode is cancelled (in the step S248) or selected (in the step S250) dependent on the state set theretofore (in the step S246).

The composite copy mode is cancelled or selected in the same manner (in the steps S252 to S260).

Figure 20:
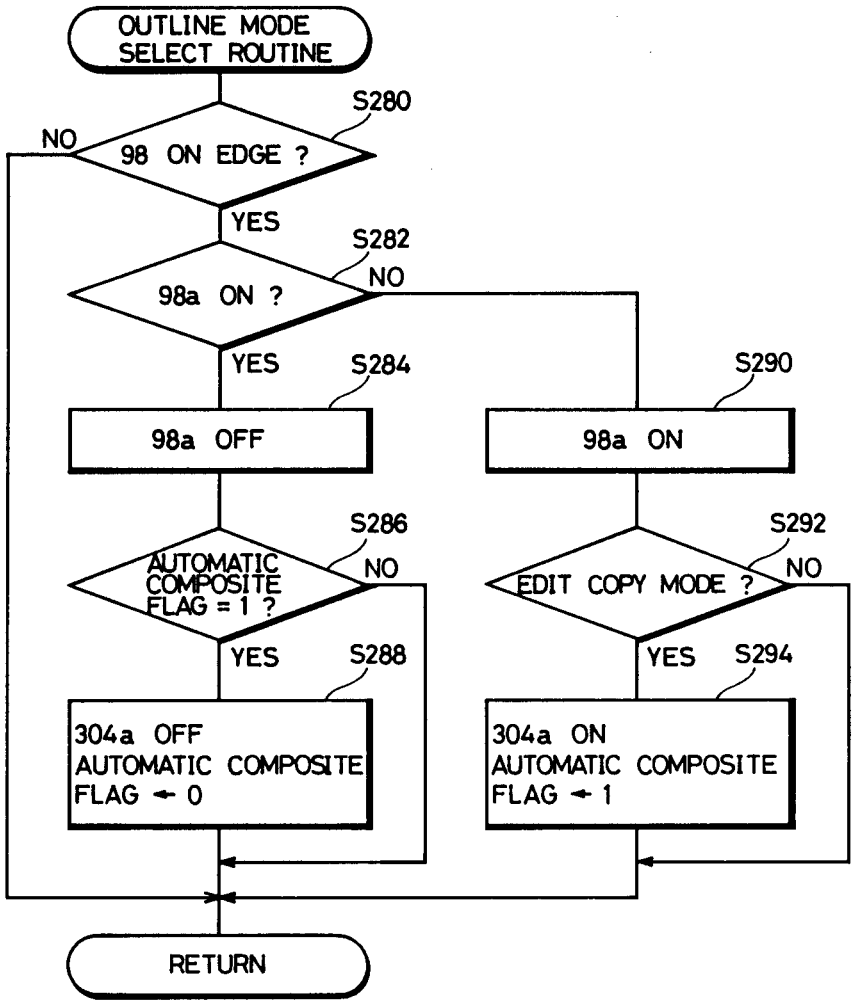
FIG. 20 is a flow chart showing details of an outline image forming mode selection routine.

FIG. 20 is a flow chart showing details of the step S110 concerning the subroutine for selecting the outline image forming mode.

When it is determined (in the step S280) that the outline mode key 98 is operated, the outline image forming mode is cancelled (in the step S284) or selected (in the step S290) dependent on the state set theretofore (in the step S282).

If the outline image forming mode is cancelled, the composite copy mode is cancelled and an automatic composite copy flag is reset to 0 (in the steps S286 and S288).

If the outline image forming mode is selected and if it is determined (in the step S292) that the edit copy mode is set, the composite copy mode is selected and the automatic composite copy flag is set to 1 (in the step S294), so that the apparatus is ready for outline composite copy operation.

Figure 21:
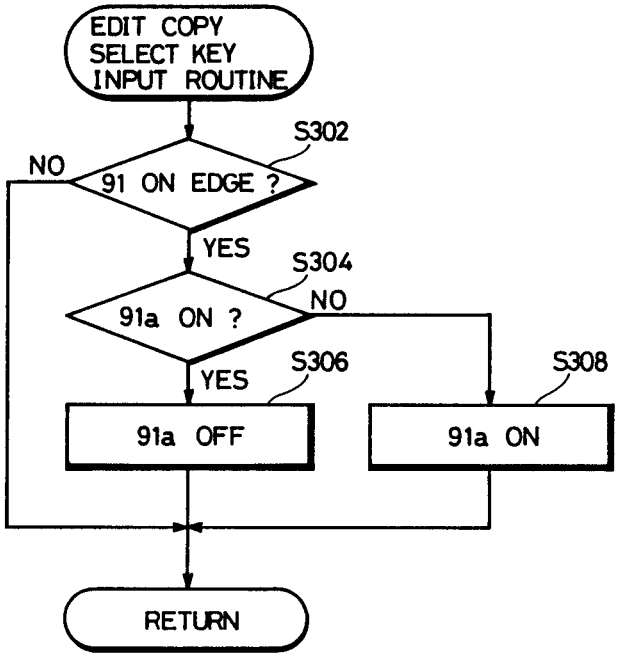
FIG. 21 is a flow chart showing details of an edit copy select key input routine.

FIG. 21 is a flow chart showing details of the step S112 concerning the subroutine for selection between the edit copy mode and the standard copy mode.

When it is determined (in the step S302) that the edit copy select key 91 is operated, the edit copy mode is cancelled (in the step S306) or selected (in the step S308) dependent on the state set theretofore (in the step S304).

Figure 22:
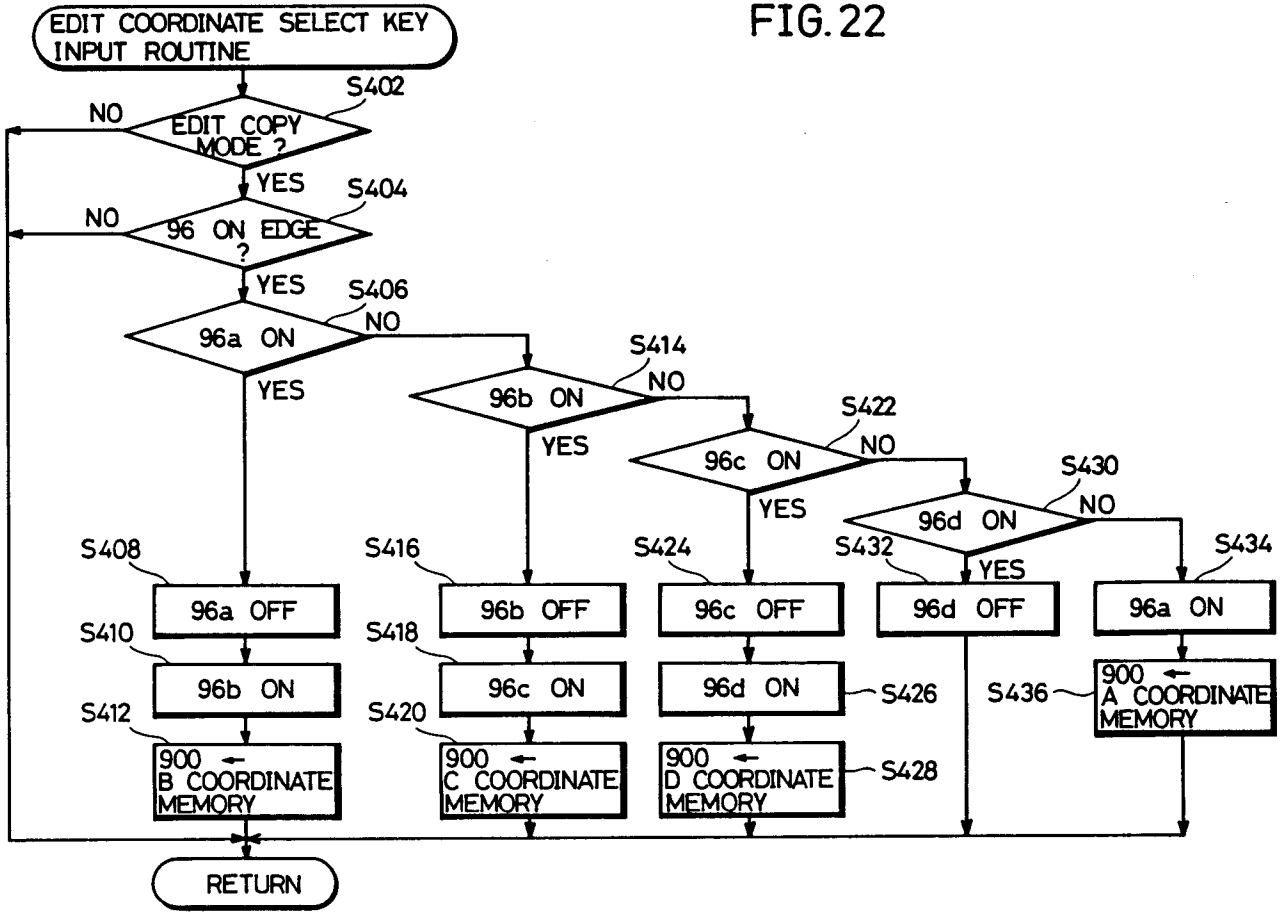
FIG. 22 is a flow chart showing details of an edition coordinate select key input routine.

FIG. 22 is a flow chart showing details of the step S114 concerning the subroutine for display of coordinate data.

If it is determined that the copy mode selected is the edit copy mode (in the step S402) and that the coordinate select key 96 is operated (in the step S404), the respective stored coordinate data are displayed successively on the display panel 900.

More specifically, if any of the coordinate display elements 96*a*, 96*b*, 96*c* and 96*d* for display of the coordinates A, B, C and D to be edited is not in the on state, the A coordinate display element 96*a* is turned on (in the step S434) and then the A coordinate data is displayed (in the step S436).

Subsequently, this display element 96*a* is turned off (in the step S408) and the B coordinate display element 96*b* is turned on (in the step S410). Then, the B coordinate data is displayed (in the step S412).

The same processing is performed for the C coordinate data and the D coordinate data (in the steps S414 to S432).

Figure 23:
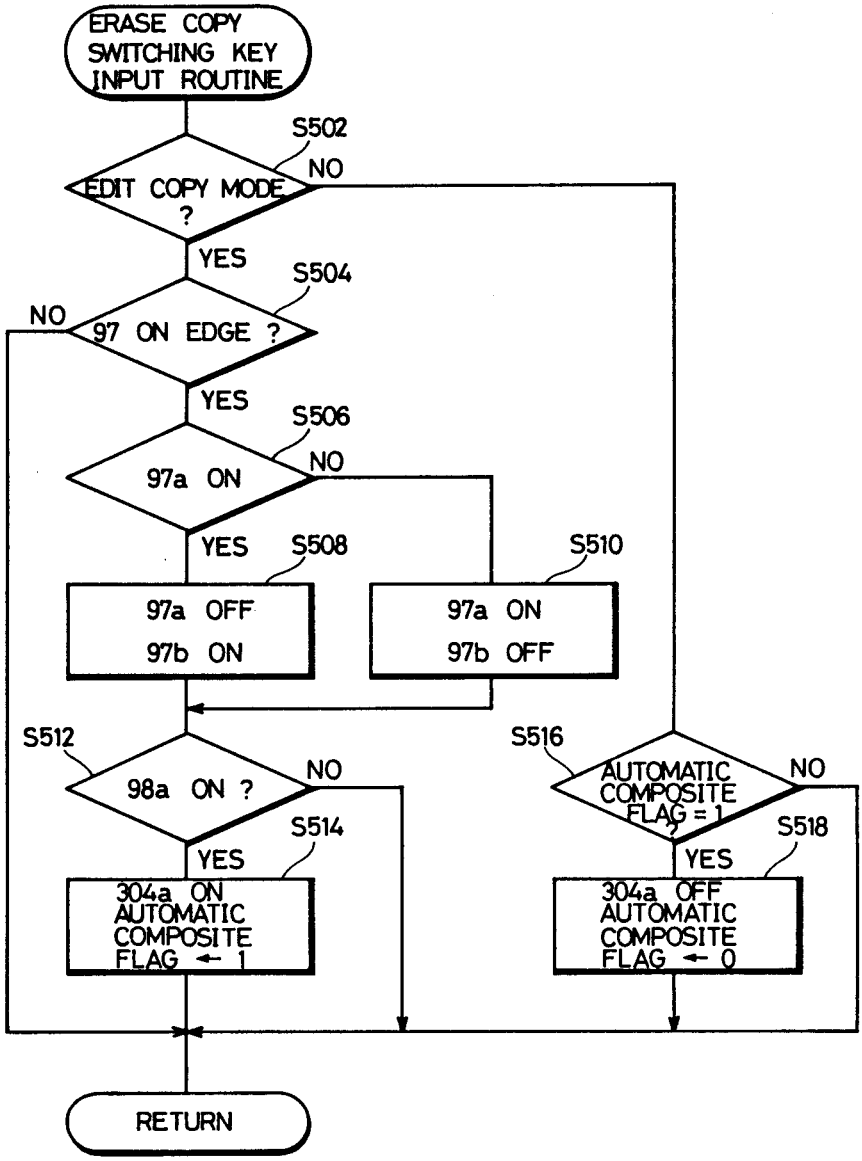
FIG. 23 is a flow chart showing details of an erase/-copy switching key input routine.

FIG. 23 is a flow chart showing details of the step S116 concerning the subroutine for selection between the erase mode and the trimming mode.

Figure 15B:
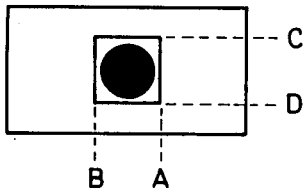
Figure 16B:
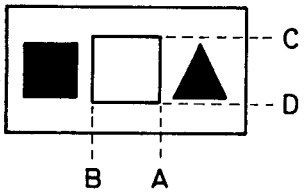

If it is determined that the copy mode selected is the edit copy mode (in the step S502) and that the erase/-trimming switching key 97 is operated (in the step S504), switching is made between the erase mode and the trimming mode (in the steps S508 and S510) dependent on the state said theretofore (in the step S506). The erase mode is a mode for erasure inside a designated area and the trimming mode is a mode for erasure outside the designated area. Specifically, an image shown in FIG. 15B is obtained when the trimming mode is designated with an area specified, and an image in FIG. 16B is obtained when the erasure mode is designated.

If the erase mode or the trimming mode is selected and if it is determined (in the step S512) that the outline mode key 98 is operated, the composite copy mode is selected and the automatic composite copy flag is set to 1 (in the step S514), so that the apparatus is ready for outline image copy operation for the designated area.

Now, two examples of image forming methods in the apparatus of the present invention will be described in detail. First, the image forming method shown in FIG. 15A will be described. In this example, the area ABCD is designated and the edit copy select key 91 is operated to select the edit copy mode and the erase/trimming switching key 97 is operated to select the trimming mode. Further, the outline mode key 98 is operated to select the outline image forming mode.

Figure 15C:
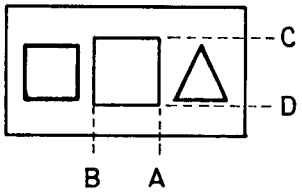

If the trimming mode is selected (in the step S508) and if it is determined that the outline mode key 98 is operated (in the step S512), a first copy operation is performed to copy an image inside a designated area in the standard copy mode. In this case, the LED elements of the erasure unit 1040 corresponding to the area outside the designated area are turned on. Thus, the image as shown in FIG. 15B is formed. The sheet of copy paper on which the first copy operation has been effected is transported to the intermediate tray unit A. Then, the sheet stored in the intermediate tray unit A is refed for a second copy operation. In the second copy operation, the LED elements of the erasure unit 1040 corresponding to the area inside the designated area are turned on and an outline image is formed for an image outside the designated area. The image formed only in the second copy operation is an shown in FIG. 15C. Those two images are composited. More specifically, the image shown in FIG. 15C is copied on the face of the copy paper where the image shown in FIG. 15B has been copied. Thus, a composite image as shown in FIG. 15A is finally formed.

As the second example, the image forming method shown in FIG. 16A will be described. In this example, the area ABCD is designated and the edit copy select key 91 is operated to select the edit copy mode and the erase/trimming switching key 97 is operated to select the erase mode. Further, the outline mode key 98 is operated to select the outline image forming mode.

Figure 16C:
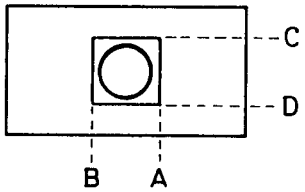
Figure 15D:
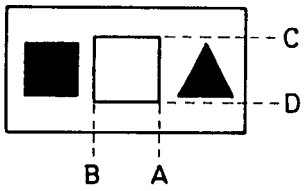
Figure 16D:
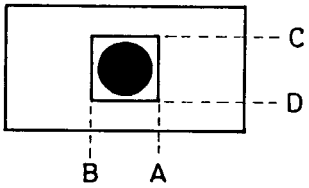

If the erase mode is selected in the step S510 and if it is determined in the step S512 that the outline mode key 98 is operated, a first copy operation is performed to copy an image outside a designated area in the standard copy mode. In this case,the LED elements of the erasure unit 1040 corresponding to the area inside the designated area are turned on. Thus, the image as shown in FIG. 16B is formed. Then, in a second copy operation, the LED elements of the erasure unit 1040 corresponding to the area outside the designated area are turned on and an outline image is formed for an image inside the designated area. The image formed in only the second copy operation is as shown in FIG. 16C. Those two images are composited in the same manner as described above, whereby a composite image as shown in FIG. 16A is finally formed.

If it is determined in the above mentioned step S502 that the edit copy mode is not selected and is determined in the step S516 that the automatic composite copy flag is set, the composite copy mode is cancelled and the automatic composite copy flag is reset to 0 (in the step S518).

Figure 24:
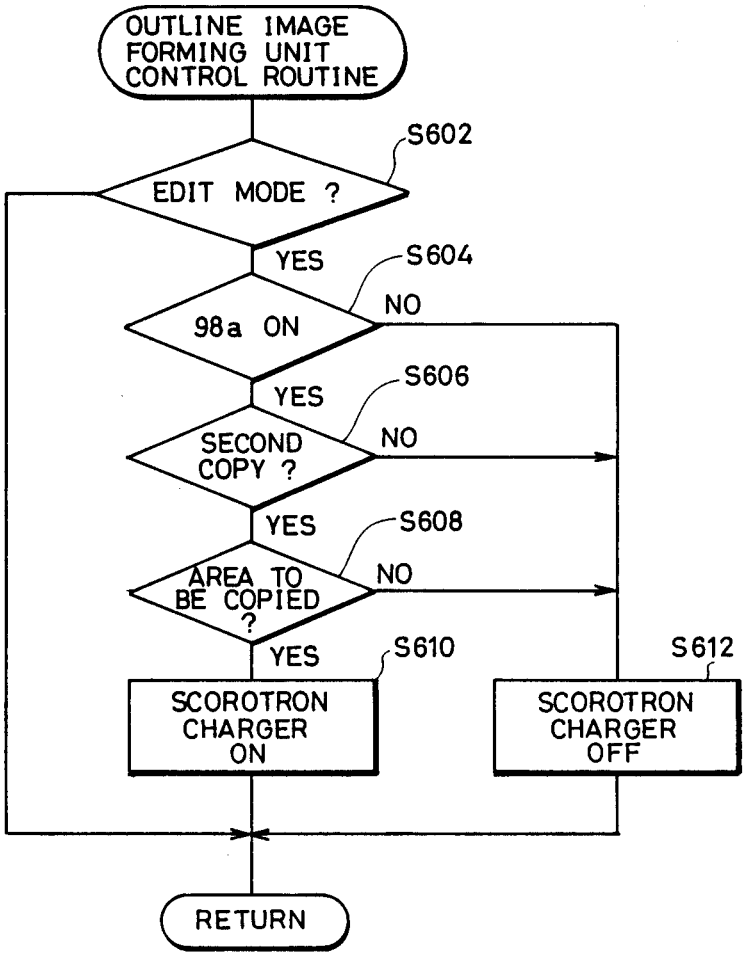
FIG. 24 is a flow chart showing details of an outline image forming unit control routine.

FIG. 24 is a flow chart showing details of the step S118 concerning the subroutine for controlling the outline image forming unit **3*b***.

As shown in FIG. 24, if the edit copy mode is selected (in the step S602) and if it is determined that the outline mode key 98 is operated (in the step S604), that the copy operation to be performed is the second copy operation for the same copy paper (in the step S606) and that an area on the photoreceptor drum 2 facing the scorotron charger 505 corresponds to an area to be copied (in the step S608), the scorotron charger 505 is turned on (in the step S610) and the potential of the electrostatic latent image portions in the area except for that of the outline portions is caused to be substantially equal to the potential for erasure. In this case where the edit copy mode is operated with only the designation of the outline mode, an image shown in FIG. 16A is obtained in the same manner explained in the case where the edit copy mode is operated with the designation of the erasure copy mode and the outline mode.

FIGS. 25A to 25D are flow charts showing details of the step S120 concerning the subroutine for controlling copy operation.

(1) If neither the duplex copy mode nor the composite copy mode is selected and when it is determined that the print key 90 is operated, a copy start flag is set to 1 to start copy operation (in the steps S702 to S708).

(2) If the duplex copy mode or the composite copy mode is selected and the apparatus is ready for duplex copy or composite copy, and when it is determined that the print key 90 is operated, the copy start flag and a first copy flag are set to 1 to start a first copy operation (in the steps S710 to S718).

(3) If the apparatus is ready for refeeding copy paper from the refeed unit A with a second copy flag being set to 1, the copy start flag is set to 1 to start another copy operation (in the steps S720 to S724). Those steps are executed after the end of the first copy operation (see the steps S764 to S768).

(4) When the copy start flag is set to 1, copy operation of the components around the photoreceptor drum 2 and feeding of the copy paper are controlled (in the steps S726 to S742).

If the above mentioned copy operation is the second copy operation in the composite copy mode or the duplex copy mode, the copy paper is fed from the refeed unit A (in the step S744).

(5) Transfer of the toner image onto the copy paper is controlled in synchronism with scanning of the optical system 1 (in the steps S746 to S758). This control is repeated until the number of copies attains a preset number (in the steps S760 to S762).

(6) When the first copy operation in the composite or duplex copy mode is completed for all the preset number of copies, the second copy flag is set to 1, so that the apparatus is ready for the second copy operation (in the steps S764 to S768).

(7) After completion of the second copy operation, copy operation stop processing is performed (in the steps S770 to S778). In addition, a signal is outputted in response to the end of the copy operation (in the step S780).

Figure 26:
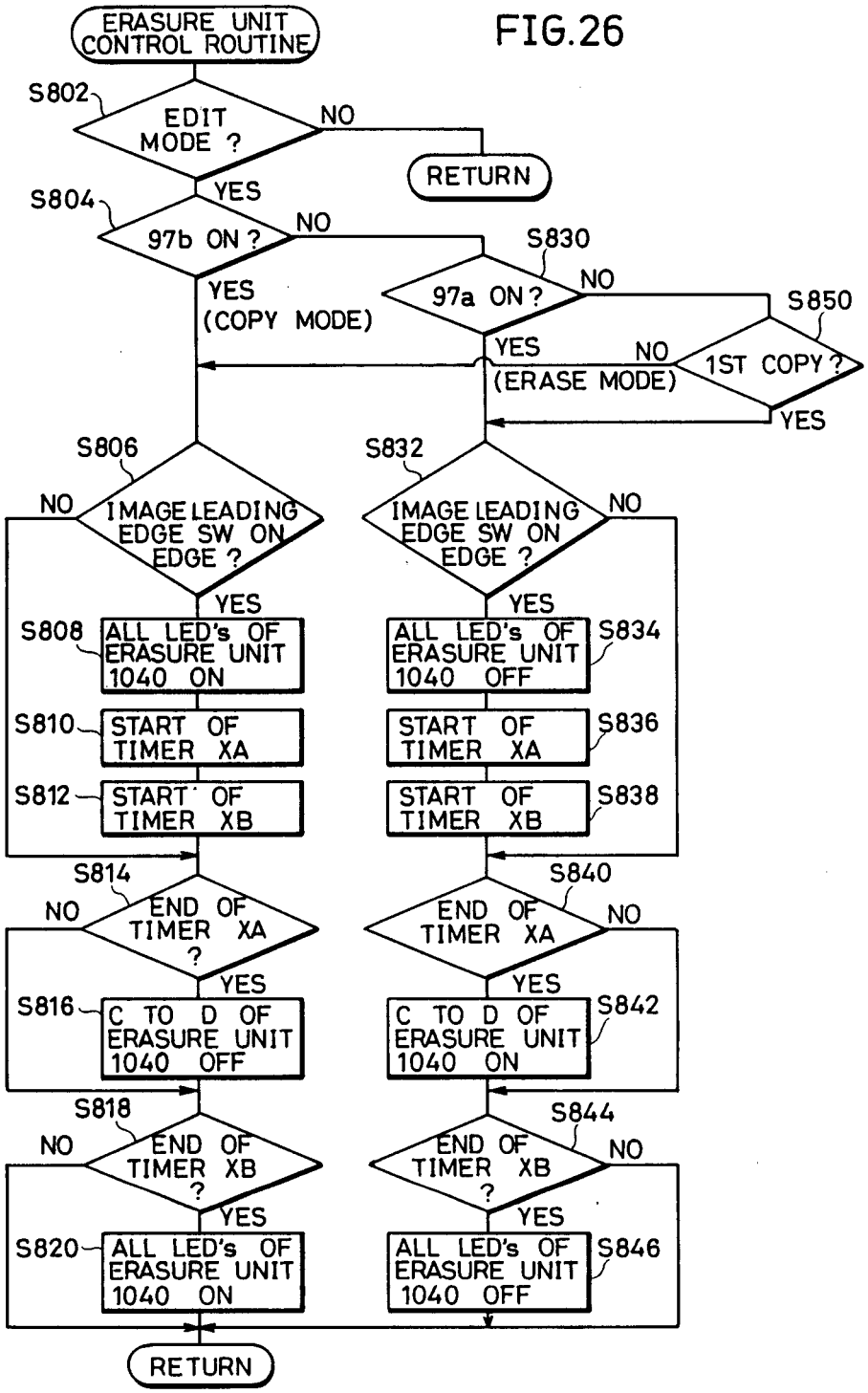
FIG. 26 is a flow chart showing details of an erasure unit control routine.

FIG. 26 is a flow chart showing details of the step S122 concerning the subroutine for controlling the erasure unit 1040.

If the edit copy mode is selected (in the step S802) and if the trimming mode is selected (in the step S804), all the LED elements of the erasure unit 1040 are turned on in a period from the moment that the unit 1040 attains a leading edge of the image to the moment that it attains a leading edge of the designated area (in the steps S806 to S814) and only the LED elements C to D corresponding to a width of the designated area are turned off in a period from the arrival at the leading edge of the designated area to the arrival at the trailing edge of the designated area (in the steps S814 to S818). Then, all the LED elements are turned on (in the step S820). Thus, the trimming mode is applied, whereby any image is not formed outside the designated area.

On the other hand, if the copy mode selected is the edit copy mode (in the step S802) and if the erase mode is selected (in the step S803), all the LED elements of the erasure unit 1040 are turned off in a period from the moment that the unit 040 attains the leading edge of the image to the moment that it attains the leading edge of the designated area (in the steps S832 to S840) and only the LED elements C to D corresponding to a width of the designated area are turned on in a period from the moment that the unit 1040 attains the leading edge of the designated area to the moment that it attains the trailing edge of the designated area (in the steps S840 to S844). After that, all the LED elements are turned off (in the step S846). Thus, the erase mode is applied, whereby any image is not formed inside the designated area.

If neither the trimming mode nor the erase mode is selected in the edit copy mode, this means that the outline image forming mode is selected. In this case, it is determined (in the step S850) whether the copy operation to be performed is the first copy operation or the second copy operation.

In the first copy operation, normal image formation is performed in the standard copy mode only for the image outside the designated area, so that a composite image is formed by using the image thus formed and an image formed by the second copy operation. Accordingly, as for the on/off control of the erasure unit 1040 in the first copy operation, the above described steps S832 to S846 are executed.

On the other hand, in the second copy operation outline image formation is executed only for the image inside the designated area. Accordingly, as for the on/-off control of the erasure unit 1040 in the second copy operation, the above described steps S806 to S820 are executed.

Thus, outline image formation is effected for the designated area and normal image formation for reproducing an original image unchanged is effected for the outside of the designated area, whereby a composite copy combining the images thus formed is obtained.

Although there is no mention of development colors for outline image formation in the above described embodiment, an outline image in color can be developed as required.

In the case of forming an outline image, if the outline mode key 98 is turned on and an area is not designated, an outline image is formed for the entire original image. In this case, only one copy operation is performed by turning on the scorotron charger 505.

Although in the above described embodiment, the normal image was formed in the first copy operation and the outline image was formed in the second copy operation, the outline image may be formed in the first copy operation, and the normal image may be formed in the second copy operation reversely. If the formation of an outline image is not required, other developing device, e.g., a developing device containing red developer may be set in the main body of the copy apparatus, in place of the outline image forming unit 3*a*.

II.

SECOND EMBODIMENT

In the above described first embodiment, when the outline mode key 98 is operated, outline image copy operation is performed always as the second copy operation. However, outline image copy operation can be performed also by the first copy operation. In the following, the second embodiment will be described.

In the second embodiment, if the trimming mode or the erase mode is selected and the outline image forming mode is selected, an outline image is formed by one copy operation without effecting composite copy. In this case, the flow chart of the subroutine for selection between the erase mode and the trimming mode is similar to that shown in FIG. 23, excluding the steps S512, S514, S516 and S518. The flow chart of the subroutine for controlling the outline image forming unit is similar to that shown in FIG. 24, excluding the step S606. More specifically, referring to FIG. 24, if the edit copy mode is selected (in the step S602), and if it is determined that the outline mode key 98 is operated (in the step S604), it is determined in the subsequent step S608 whether an area on the photoreceptor drum 2 facing the scorotron charger 505 corresponds to an area to be copied. If it is determined in the step S608 that the area on the photoreceptor drum 2 facing the scorotron charger 505 corresponds to the area to be copied, the scorotron charger 505 is turned on (in the step S610). If it does not correspond to the area to be copied, the scorotron charger 505 is turned off (in the step S612). Thus, an image in the area to be copied is formed as an outline image.

In the second embodiment, if the trimming mode and the outline image forming mode are both selected, which means that the edit copy select key 91 and the erase/trimming switching key 97 are operated to select the trimming mode and that the outline mode key 98 is operated, an outline image for only an image inside the area , i.e., an image as shown in FIG. 16C is obtained by one copy operation. On the other hand, if the erase mode and the outline image forming mode are both selected, which means that the edit copy select key 91 and the erase/trimming switching key 97 are operated to select the erase mode and that the outline mode key 98 is operated, the image inside the area is erased and an outline image for the image outside the area is obtained by one copy operation, as shown in FIG. 15C.

III.

THIRD EMBODIMENT

In the above described first and second embodiments, monochrome edition outline copy can be made, while in this third embodiment, edition outline copy in two colors can be made.

Figure 27:
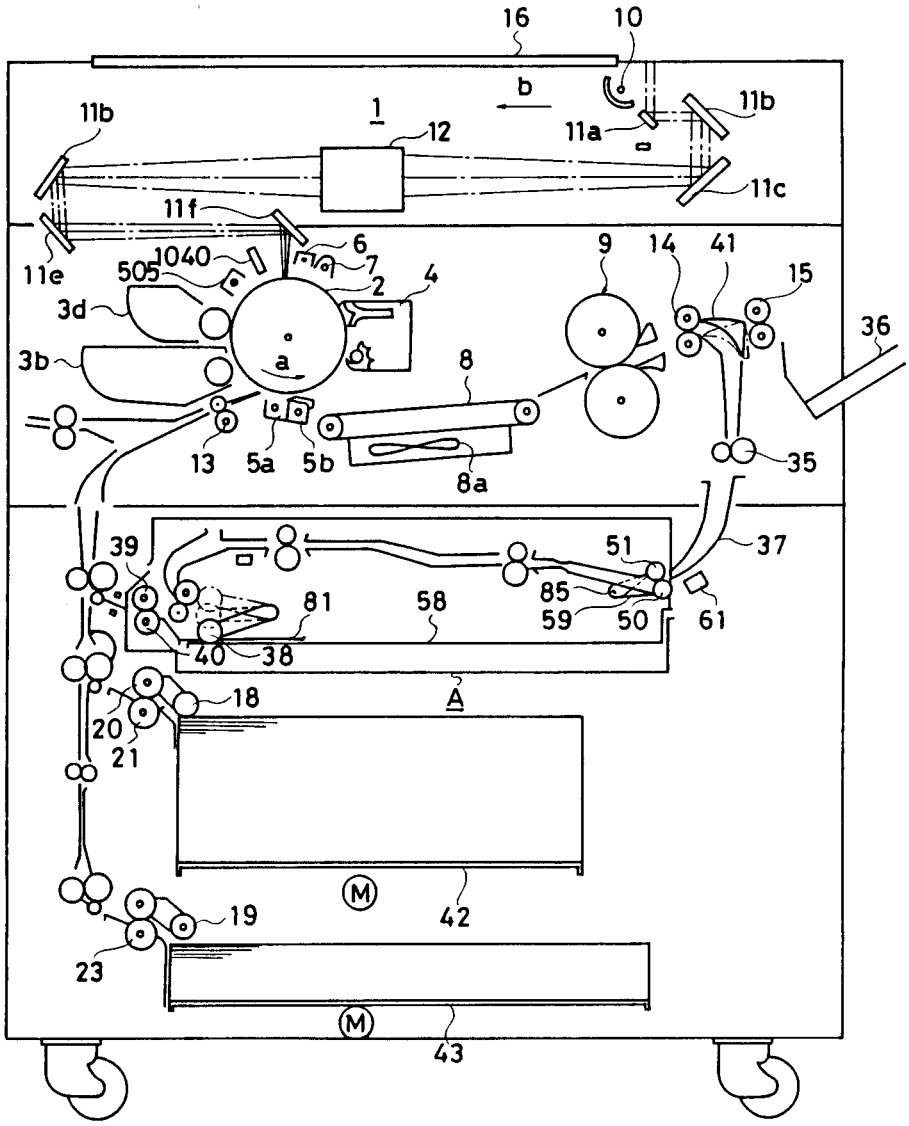
FIG. 27 is a view showing a total construction of a copying apparatus of a third embodiment of the present invention.

FIG. 27 is a view showing a total construction of a copying apparatus of the third embodiment. As shown in FIG. 27, there are provided, around the photoreceptor drum 2, a corona charger 6, an erasure unit 1040, a scorotron charger 505, magnetic brush-type developing devices 3*d* (for red toner) and 3*b* (for black toner), a transfer charger 5*a*, a copy paper separation charger 5*b*, a blade-type cleaning device 4 and an eraser lamp 7. The scorotron charger 505 is fixed as is different from that shown in FIG. 6. In this embodiment, the latent image formed on the photoreceptor drum 2 is subjected to the development by the developing device 3*d* or 3*b*, whereby a toner image is formed. Construction of the optical system 1, the copy paper storing portion and the like, and operation thereof are substantially the same as in the case of FIG. 6 and therefore description thereof is omitted.

Figure 28:
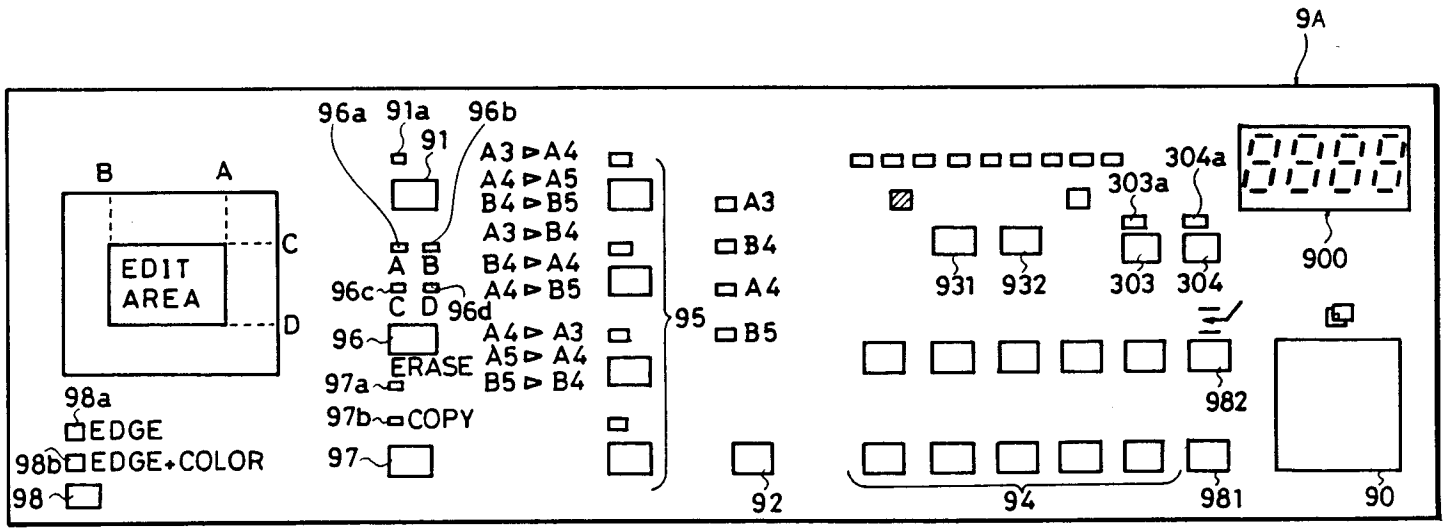
FIG. 28 is a plan view of an operation panel of the copying apparatus shown in FIG. 27.

FIG. 28 is a plan view of the operation panel 9A of the copying apparatus shown in FIG. 27. The outline mode key 98 provided on the operation panel 9A of FIG. 28 is used for switching between a monochrome outline image forming mode and a color outline image forming mode. When the monochrome outline image forming mode is selected, the LED element 98*a* is turned on and an outline image in black toner is obtained. When the color outline image forming mode is selected, the LED element 98*b* is turned on and an outline image in red toner is obtained. In the latter case, if an area is designated, a red outline image is formed in the designated area and a normal black image in the standard copy mode is formed outside the designated area.

Figure 29:
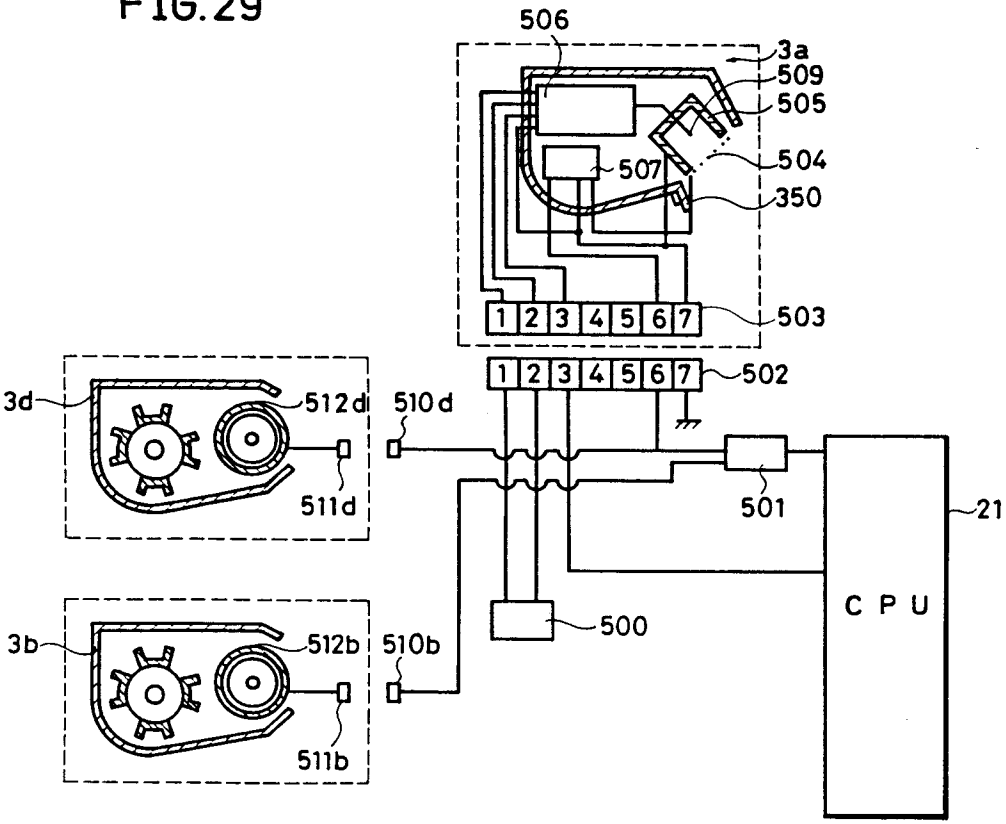
FIG. 29 is a circuit diagram showing connections of an outline image forming portion including a scorotron charger, two developing devices and a CPU.

FIG. 29 is a circuit diagram showing connections of the outline image forming unit 3*a* including the scorotron charger 505, the developing devices 3*d* and 3*b*, and the CPU 21.

As shown in FIG. 29, the outline image forming unit 3*a* and the developing devices 3*d* and 3*b* are controlled by the CPU 21.

More specifically, a predetermined development bias voltage of +200 V is applied to the developer sleeves 512*d* and 512*b* of the developing devices 3*d* and 3*b*, respectively, through the connectors 510*d*, 511*d*, and the connectors 510*b*, 511*b*, respectively, from the power supply 501.

A voltage of +150 V is applied from the power supply 501 to the grid 504 of the scorotron charger 505 through the connectors 502, 503 and the distributor 507.

A voltage of DC +24 V is constantly supplied from the power supply 500 to the high-voltage power supply 506 for applying a high voltage of −6.0 kV to the charge wire 509.

Since construction of the control portion and the erasure unit, and main operation of this third embodiment are the same as described in the case of the first embodiment, description thereof is omitted. In the following, selection of the color outline image forming mode and operation of color outline image formation will be described.

Figure 30:
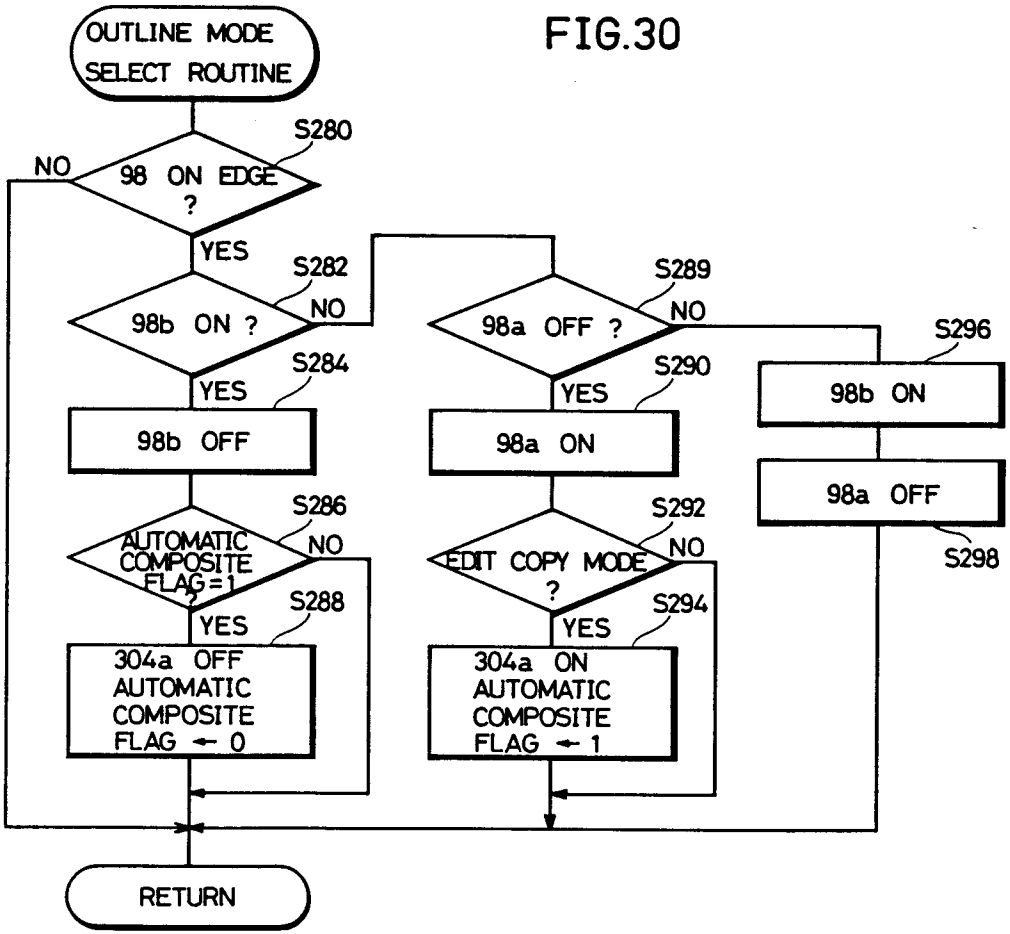
FIG. 30 is a flow chart showing details of an outline copy selection routine in the third embodiment.

FIG. 30 is a flow chart showing details of the subroutine for selection of the outline image forming mode, which is similar to FIG. 20 for the first embodiment.

As shown in FIG. 30, when it is determined that the outline mode key 98 is operated (in the step S280) and that the mode set theretofore is the monochrome outline image forming mode (in the steps S282 and S289), the monochrome outline image forming mode is cancelled (in the step S298) and the color outline image forming mode is selected (in the step S296).

If the mode set theretofore is the color outline image forming mode (in the step S282), the color outline image forming mode is cancelled (in the step S284) and, further, the composite copy mode is cancelled and the automatic composite copy flag is reset to 0 (in the steps S286 to S288).

If the mode set theretofore is neither the monochrome outline image forming mode nor the color outline image forming mode (in the steps S282 and S289), the monochrome outline image forming mode is selected (in the step S290) and if the edit copy mode is set (in the step S292), the composite copy mode is selected and the automatic composite copy flag is set to 1 (in the step S294), so that the copying apparatus is ready for outline image composite copy.

Figure 31:
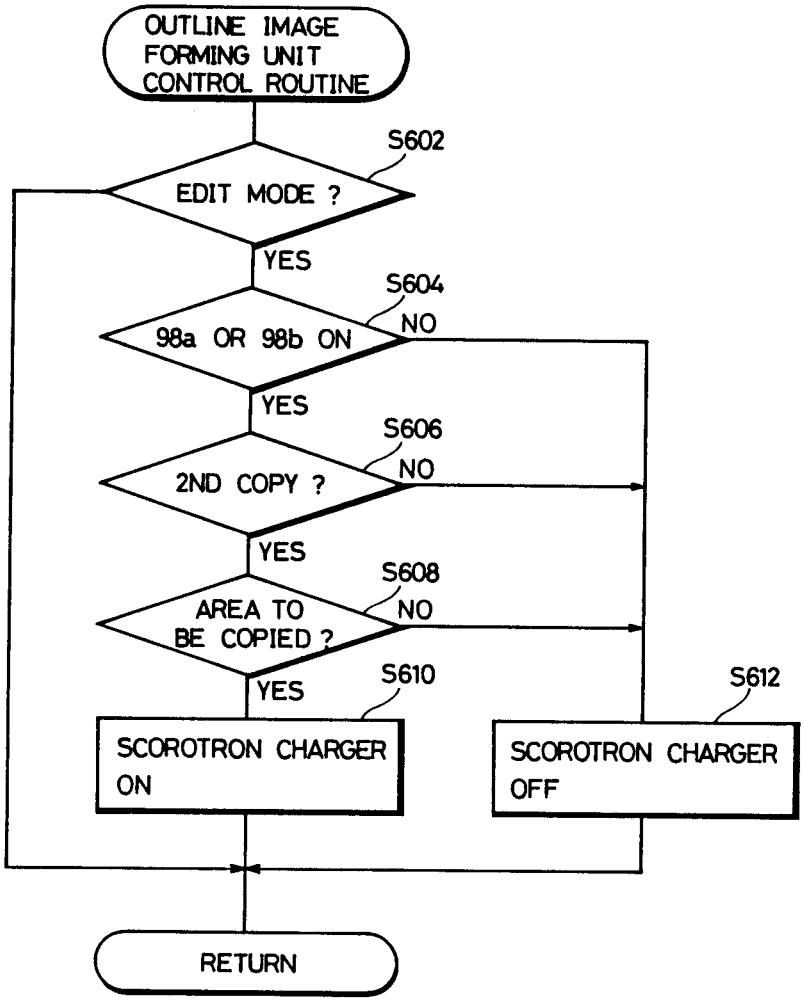
FIG. 31 is a flow chart showing details of an outline image forming unit control routine in the third embodiment.

FIG. 31 is a flow chart showing details of the subroutine for controlling the outline image forming unit, which is similar to FIG. 24 in the case of first embodiment.

As shown in FIG. 31, if the edit copy mode is selected (in the step S602), and when it is determined that the monochrome outline image forming mode or the color outline image forming mode is selected (in the step S604), that the copy operation to be performed is the second copy operation for the same copy paper (in the step S606) and that the region on the photoreceptor drum 2 facing the scorotron charger 505 corresponds to an area to be copied (in the step S608), the scorotron charger 505 is turned on (in the step S610) and the potential of the electrostatic latent image in the area except for that of the outline portions is caused to be substantially equal to the erasure potential.

Figure 25A:
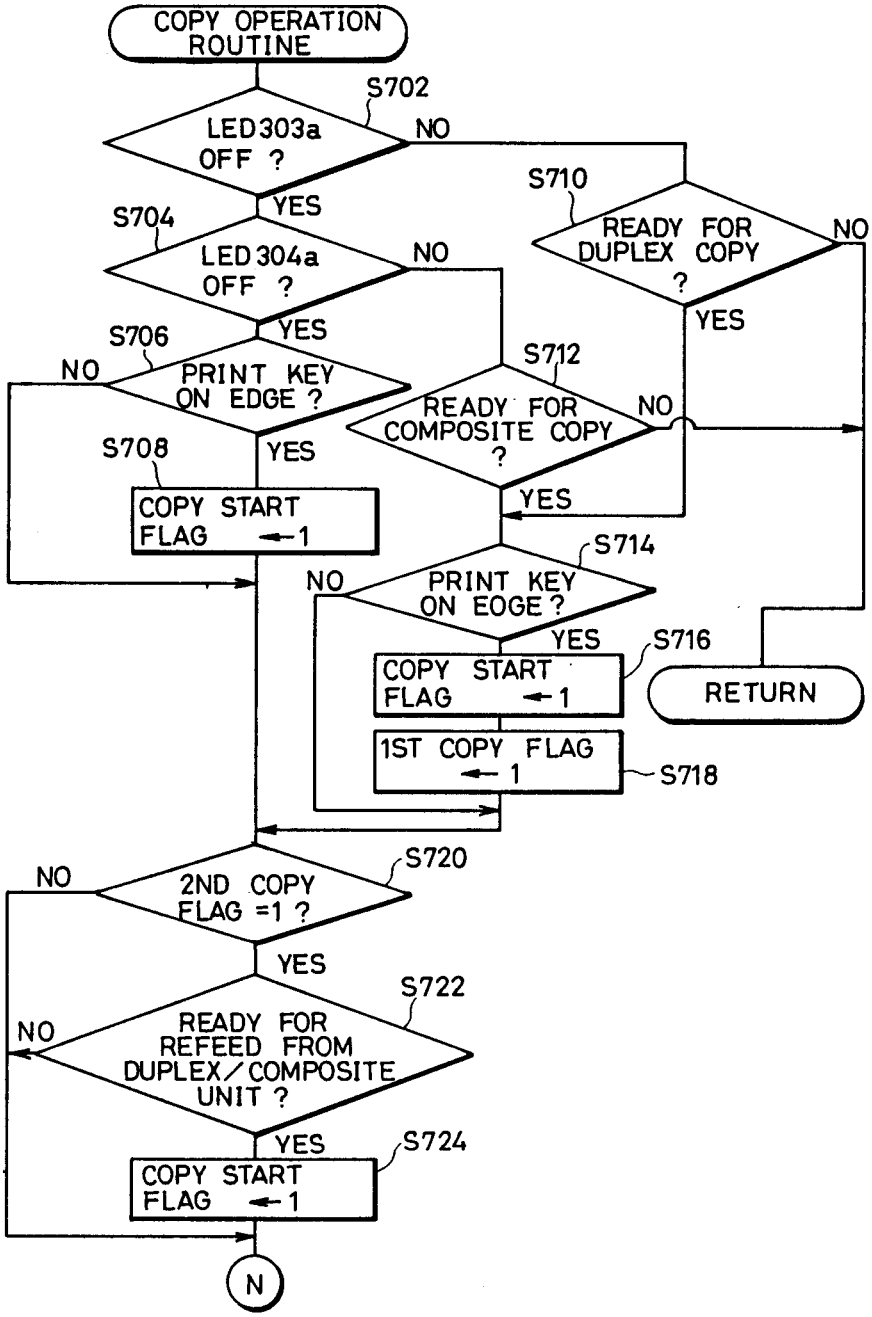
FIGS. 25A to 25D are flow charts showing details of a copy operation routine.
Figure 25B:
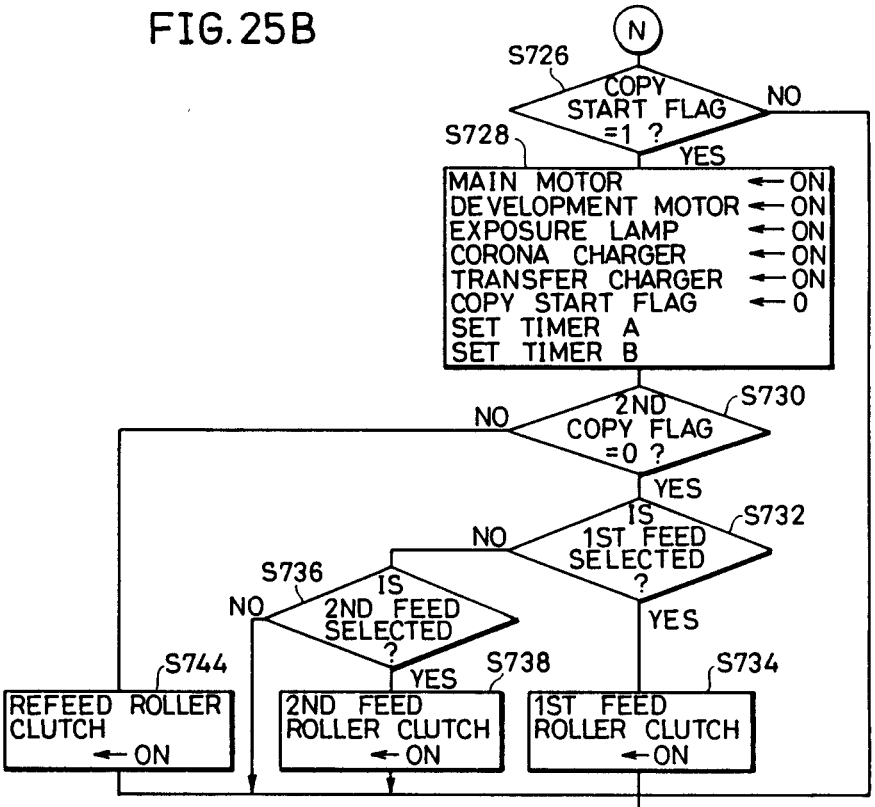
Figure 25C:
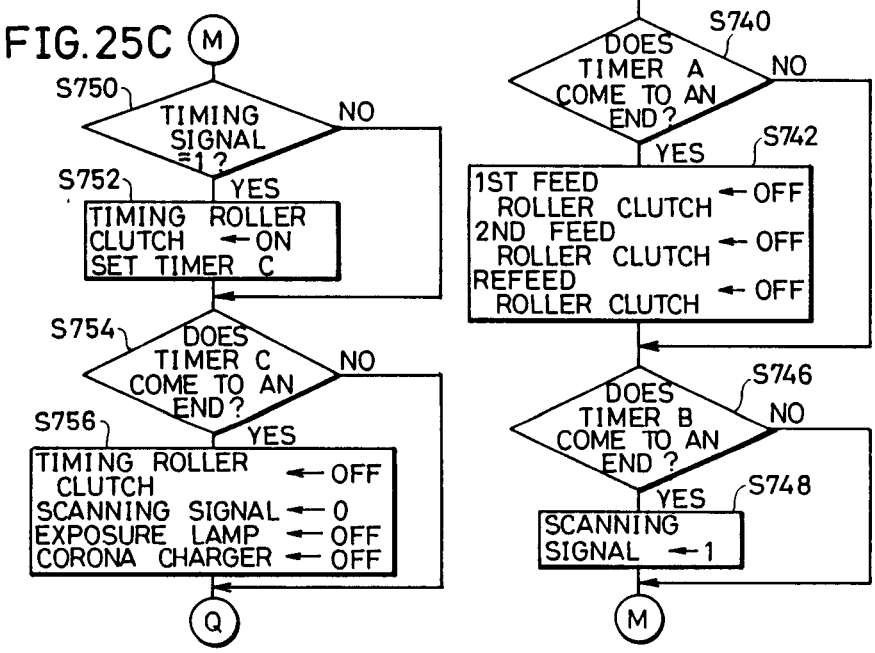
Figure 25D:
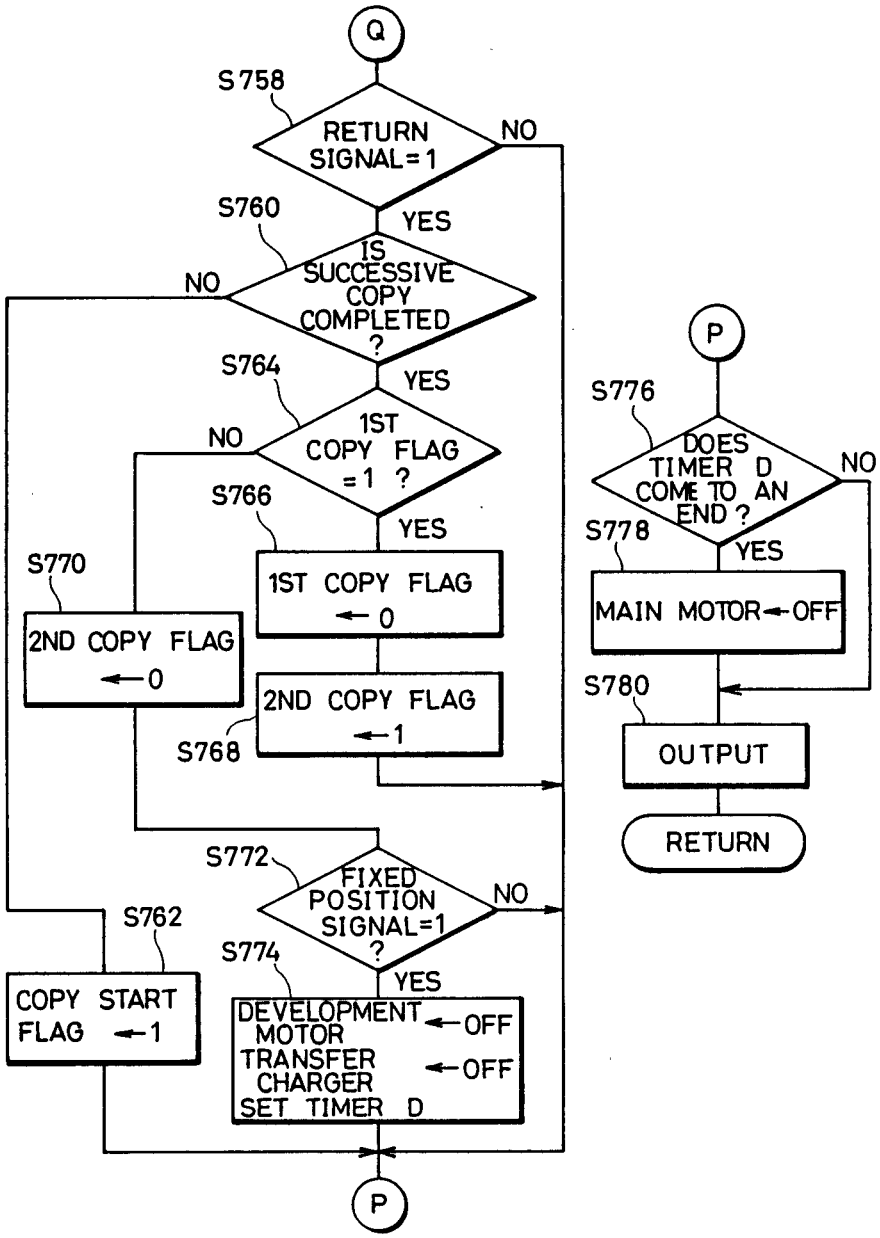
Figure 32:
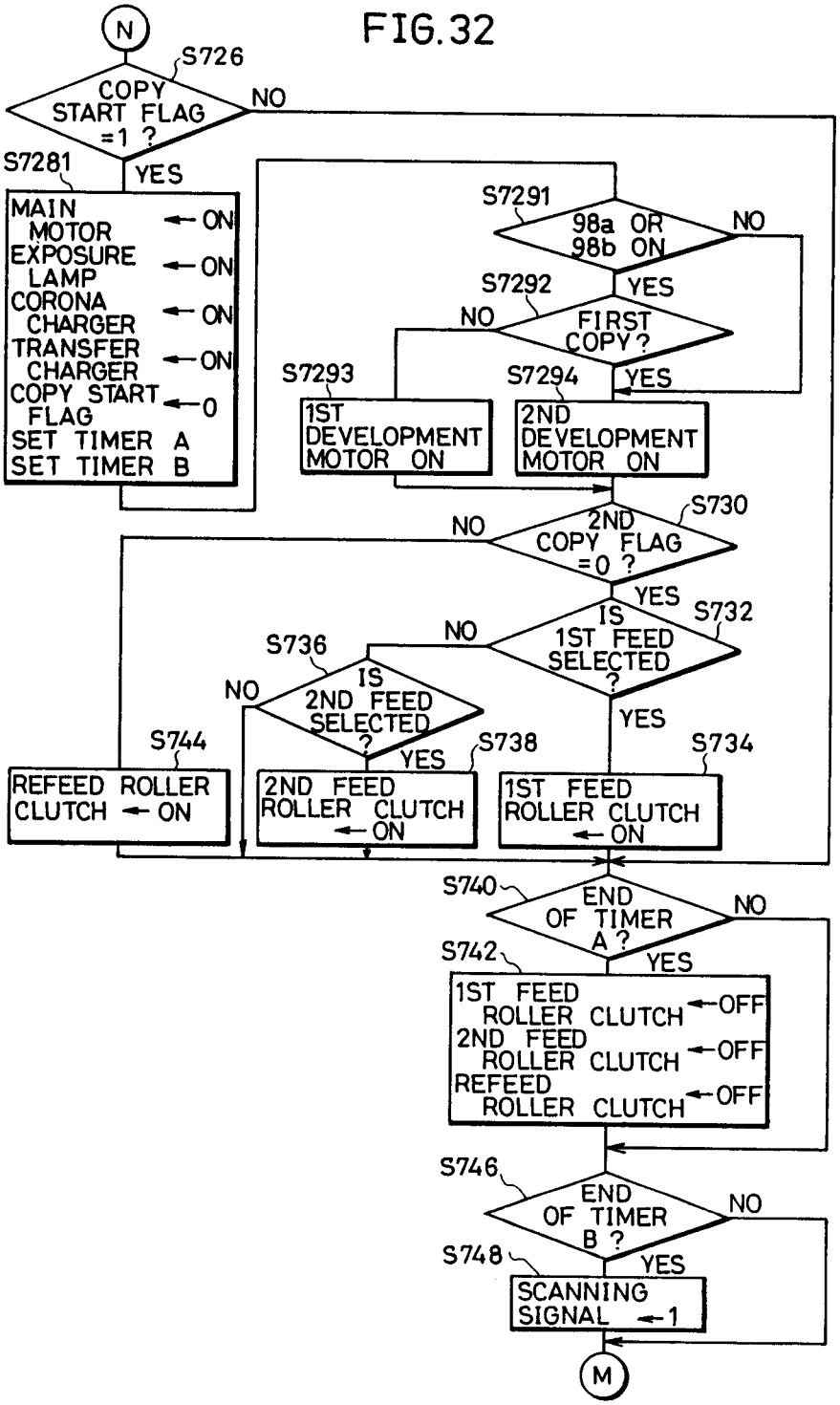
FIG. 32 is a flow chart showing a part of a copy operation routine in the third embodiment.

FIG. 32 is a flow chart showing a part of the copy operation routine, which is similar to FIG. 25B in the case of the first embodiment. In the third embodiment, if the monochrome outline image forming mode or the color outline image forming mode is selected, the second development motor (for black toner) is turned on at the time of the first copy operation and the first development motor (for red toner) is turned on at the time of the second copy operation.

In this third embodiment, if the color outline image mode is selected, a normal black image is formed outside the designated area and a red outline image is formed inside the designated area. However, it is possible to form a normal red image outside the designated area and to form a black outline image inside the designated area in the color outline image forming mode.

In the latter case, the above described color outline image forming mode can be applied by using the key 98*c* (not shown) provided on the panel 9A shown in FIG. 28, for example. If this copy mode is selected, the first development motor (for red toner) is turned on at the time of the first copy operation and the second development motor (for black toner) is turned on at the time of the second copy operation.

Although the scorotron charger 505 is fixed in the main body of the copying apparatus in this third embodiment, it may be incorporated in a demountable unit. In the latter case, the user may place the unit in the copying apparatus when the user wants to perform outline copy operation.

Alternatively, the scorotron charger 505 may be formed as a unit which can be mounted in place of one of the developing devices, as in the first embodiment. In this case, if color outline image forming operation is to be performed in the copying apparatus, three or more developing devices for example are allowed to be mounted therein, the scorotron charger 505 being mounted at the most upstream position, the developing device containing red developer being mounted at an intermediate position and the developing device containing black developer being mounted at the most downstream position, as viewed along the direction of rotation of the photoreceptor drum 2. If outline image forming operation is not needed, a developing device containing developer of desired color may be mounted in place of the above mentioned unit.

Although the number and the order of developing devices to be mounted are not limited to those described above, the scorotron charger 505 needs to be mounted in a position excluding the most downstream position along the rotating direction of the photoreceptor drum 2.

IV.

DESCRIPTION OF A FOURTH EMBODIMENT

The scorotron charger 505 may be incorporated in a demountable unit as in the first embodiment or may be fixed as in the third embodiment. A concrete example including the scorotron charger as the demountable unit will be described as the fourth embodiment.

Figure 33A:
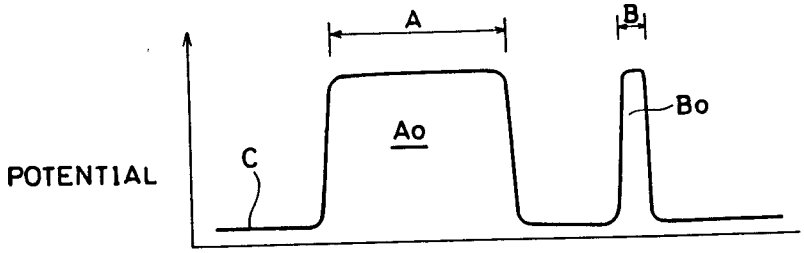
FIGS. 33A to 33D are diagrams showing an outline image forming process in a fourth embodiment.
Figure 33B:
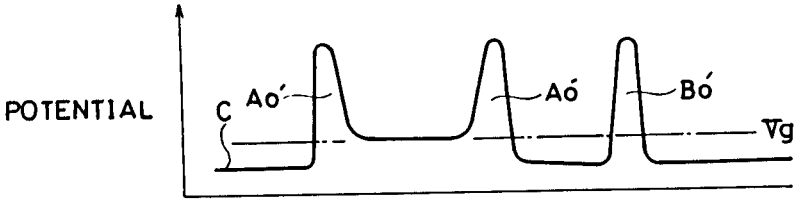
Figure 33C:
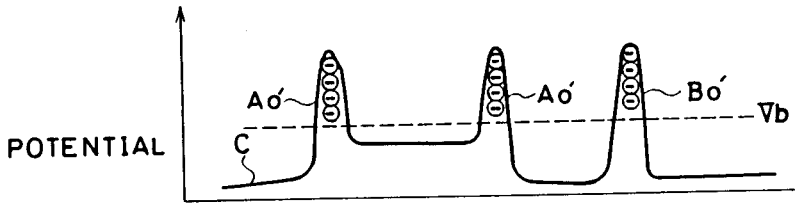

More specifically, in the first to third embodiments, in the case of the outline image forming mode, the grid voltage Vg is set to about +150 V and the development bias voltage Vb is set to about +200 V if an initial surface potential applied to the surface of the photoreceptor drum 2 by the corona charger 6 is about +600 V, as shown in FIGS. 33A to 33C, thereby to clearly pick up outline portions. If the development bias voltage Vb is lowered to Vb', a potential difference between the development bias voltage Vb' and the electrostatic latent image surface potential in a central portion Ao'' of the image excluding outline portions Ao' could not be maintained sufficiently large, causing toner to adhere to surrounding portions of the outline portions Ao', and clear outlines could not be obtained. On the other hand, in the case of the standard copy mode in which an original image as shown in FIG. 2 is reproduced as it is without using the outline image forming unit 3*a*, it is desirable to set the development bias voltage Vb to about +150 V. This is because it is necessary to prevent adhesion of toner to the non-image area c of the photoreceptor drum 2 subjected to the exposure since electric charge of about +80 V usually remains in that area c and it is also necessary to ensure a sufficiently large potential difference between the non-image area c and the electrostatic latent image portions Ao and Bo, thereby to maintain a suitable image density. Although a method of increasing the voltage applied to the corona charger 6 may be used to maintain a high surface potential in the electrostatic latent image portions Ao and Bo, a large amount of ozone would be generated if such method is adopted.

Thus, it is preferable to change the development bias voltage Vb to +200 V in the outline image forming mode or to +150 V in the standard copy mode. If two power supplies for applying those voltages are provided in the main body of the copying apparatus, the manufacturing cost of the copying apparatus is increased and the two power supplies are not effectively utilized for the user who does not need the outline image forming function. The present fourth embodiment has obviated those inconveniences.

Figure 34:
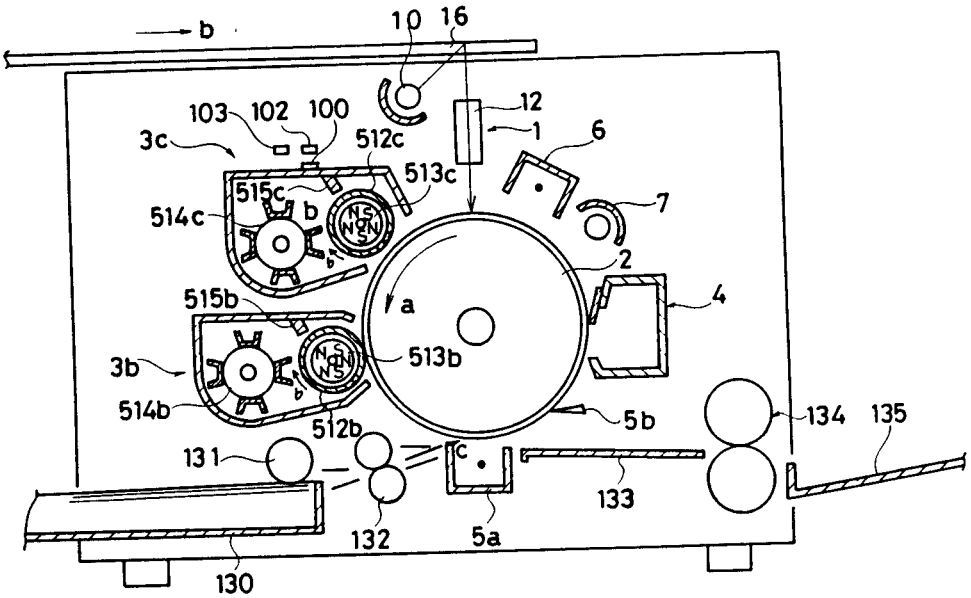
FIG. 34 is a view showing a construction of an image forming apparatus of the fourth embodiment, particularly representing a state in which to developing devices are installed around a photoreceptor drum.
Figure 35:
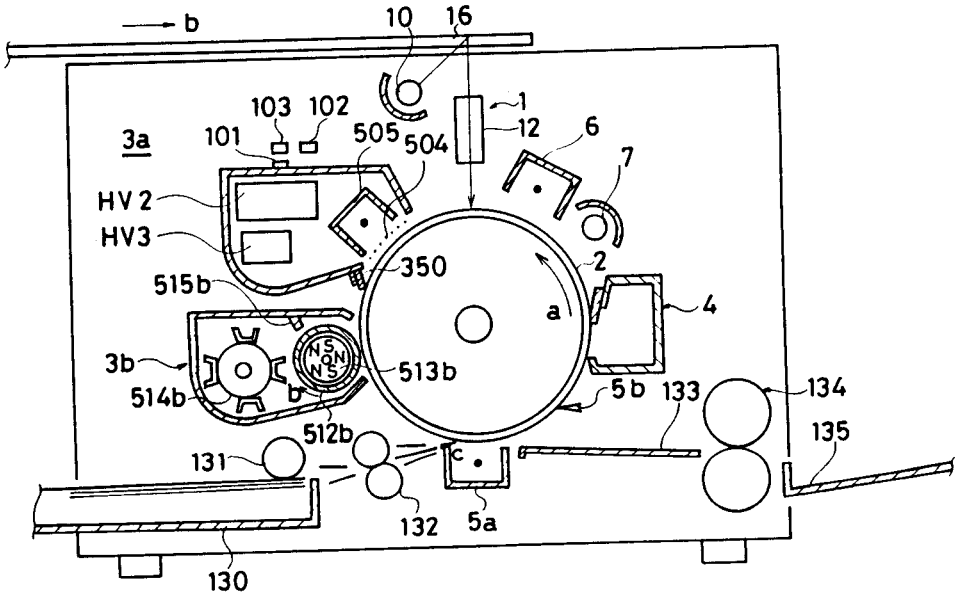
FIG. 35 is a view showing a construction of an image forming apparatus of the fourth embodiment, particularly representing a state in which an outline image forming unit is mounted in place of the first developing device.

FIGS. 34 and 35 schematically show an electrophotographic copying apparatus of the fourth embodiment. Particularly, FIG. 34 shows a case in which a first developing device 3*c* is mounted and FIG. 35 shows a case in which an outline image forming unit 3*a* is mounted in place thereof.

The well-known electrophotographic photoreceptor drum 2 having a photoconductive layer on its outer surface is provided nearly in the central portion of the copying apparatus, in a manner rotatable in the direction of the arrow a, with the below described members and devices being located around the drum 2.

A corona charger 6 serves as a first charging device for applying electric charge of a predetermined potential of +600 V to the surface of the photoreceptor drum 2.

An exposure device 1 applies light to an original placed on document glass plate 16 scanned in the direction of the arrow b, thereby to form an electrostatic latent image corresponding to the original image, on the surface on the photoreceptor drum 2 by a well-known slit exposure system. The exposure device 1 comprises an exposure lamp 10, a lens array 12 with a focusing light transmitting body, and the like.

The first developing device 3*c* forms a visible toner image by a magnetic brush system from the electrostatic latent image formed on the surface of the photoreceptor drum 2. It comprises a developer sleeve 512*c* containing a stop type magnet roller 513*c* having an N and S poles in its circumferential portion, and a bucket roller 514*c* for mixing developer. A second developing device 3*b* has the same construction as that of the first developing device 3*c*. Developer containing color toner is stored in the first developing device 3*c* and developer containing black toner is stored in the second developing device 3*b*. Either of the developing devices 3*c* and 3*b* is selectively driven in the standard copy mode to be described afterwards.

The developer is a mixture of magnetic carrier and insulating toner, which are charged with opposite polarities by friction charging. In this fourth embodiment, the insulating toner is charged with a polarity opposite to that of the corona charger 6, that is, it is charged with the negative polarity. The developer is held on the surface of the developer sleeve 512*c* or 512*b* in a brush form by magnetic force of the magnetic roller 513*c* or 513*b* and it is fed in the direction of the arrow b by rotation of the developer sleeve 512*c* or 512*b* with the brush form being regulated by a regulator plate 515*c* or 515*b*, thereby to develop the electrostatic latent image formed on the surface of the photoreceptor drum 2.

A transfer charger 5*a* applies an electric field to a back surface of copy paper transported from the direction of the arrow c, so that the tone image formed on the surface of the photoreceptor drum 2 by the developing device 3*c* or 3*b* is transferred onto the copy paper.

A separation claw 5*b* serves to separate the copy paper having the transferred image from the surface of the photoreceptor drum 2. A cleaning device 4 serves to remove residual toner on the surface of the photoreceptor drum 2 by the blade system. The eraser lamp 7 serves to remove residual charge on the surface of the photoreceptor drum 2 by irradiating the surface, whereby the copying apparatus is prepared for the subsequent copy process.

A paper feed cassette 130 is provided on the left side of the photoreceptor drum 2 in the figure and fixation rollers 134 and a discharge tray 135 are provided on the right side thereof.

Figure 36:
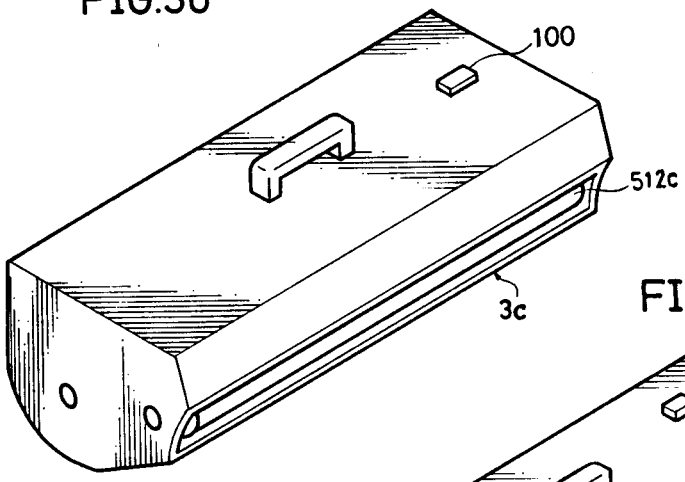
FIG. 36 is a perspective view of one of the developing devices in the fourth embodiment.
Figure 37:
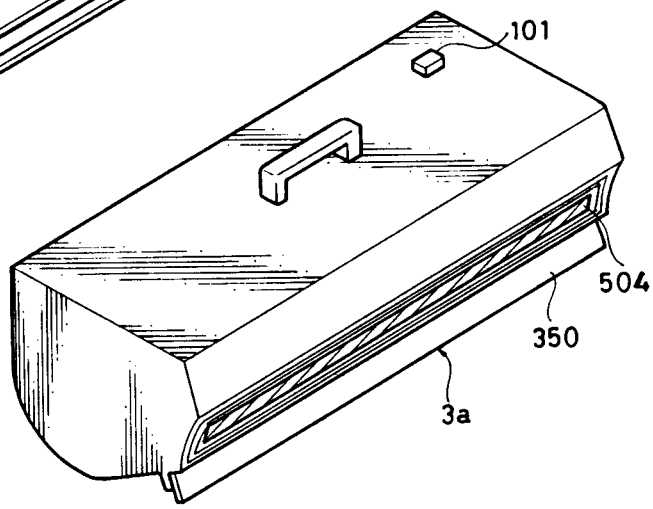
FIG. 37 is a perspective view of the outline image forming unit in the fourth embodiment.

The outline image forming unit 3*a* as shown in FIG. 37 has almost the same external shape as that of the first developing device 3*c* shown in FIG. 36. The outline image forming unit 3*a* can be mounted in the main body of the copying apparatus interchageably with the first developing device 3*c*. This unit 3*a* contains a scorotron charger 505 functioning as a second charging device, and high-voltage power supplies HV2 and HV3. The scorotron charger 505 has a grid 504 in an opening thereof opposed to the photoreceptor drum 2. A seal member 350 is fixed to a lower portion of the unit 3*a* facing the surface of the photoreceptor drum 2. The seal member 350 is made of a flexible insulating material such as a polyester film or polyurethane rubber. When the unit 3*a* is mounted in the copying apparatus, the top end of the seal member 350 is in contact with the surface of the photoreceptor drum 2 to shut off the particles of toner produced from the second developing device 3*b* at the time of the copy operation, whereby the charge wire 509 or the grid 504 of the scorotron charger 505 can be prevented from being fouled by the toner particles. Needless to say, since the seal member 350 is the insulating material, it does not cause any disturbance to the electrostatic latent image on the photoreceptor drum 2.

Magnets 101 and 100 are provided on a casing of the unit 3*a* and that of the first developing device 3*c*, respectively, while switches 102 and 103 are provided in the main body of the copying apparatus. The magnet 101 turns on the switch 103 when the unit 3*a* is mounted in the main body of the copying apparatus, and the magnet 100 turns on the switch 102 when the first developing device 3*c* is mounted in the main body of the copying apparatus. A signal generated by the turn-on of either switch is inputted to a CPU to be described afterwards, thereby to determine whether the unit 3*a* or the first developing device 3*c* is mounted in the copying apparatus.

Now, connections in the developing devices 3*c* and 3*b* and the outline image forming unit 3*a* will be described.

Figure 38A:
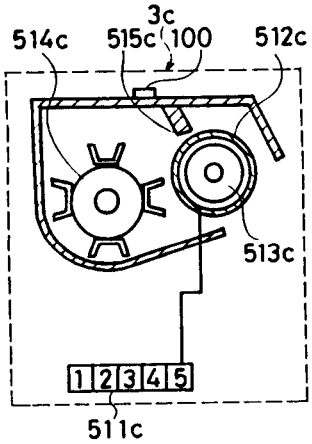
FIG. 38A represents a sectional view of a developing device and a circuit diagram thereof in the fourth embodiment.

Referring to FIG. 38A, the first developing device 3*c* has a connector 511*c* and a fifth pin of the connector 511*c* is connected to the developer sleeve 512*c*.

Figure 38B:
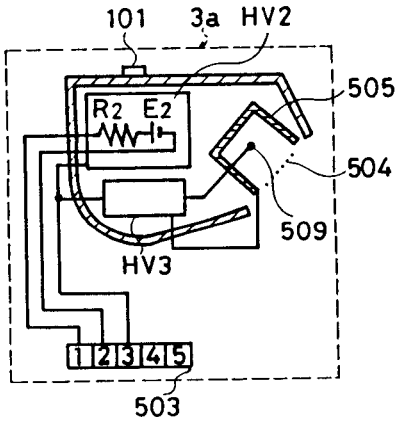
FIG. 38B represents a sectional view of the outline image forming unit and a circuit diagram thereof in the fourth embodiment.

Referring to FIG. 38B, the outline image forming unit 3*a* has a connector 503 having the same shape as that of the connector 511*c*. The respective pins of the connector 503 are connected as follows..

First pin: to a plus terminal of the high-voltage power supply HV2

Second pin: to a minus terminal of the high-voltage power supply HV2

Third pin: to remote terminals of the high-voltage power supplies HV2 and HV3

Fourth and fifth pins: open.

The power supply HV2 has an electromotive force E2 of +250 V and a resistance R2. The power supplies HV2 and HV3 are turned on and off in response to input signals from the remote terminals thereof.

In the unit 3*a*, an output terminal of the high-voltage power supply HV3 is connected to the charge wire 509 of the scorotron charger 505 and an output terminal of another power supply (not shown) contained in the power supply HV3 is connected to the grid 504, predetermined voltages being applied to those output terminals.

Figure 40:
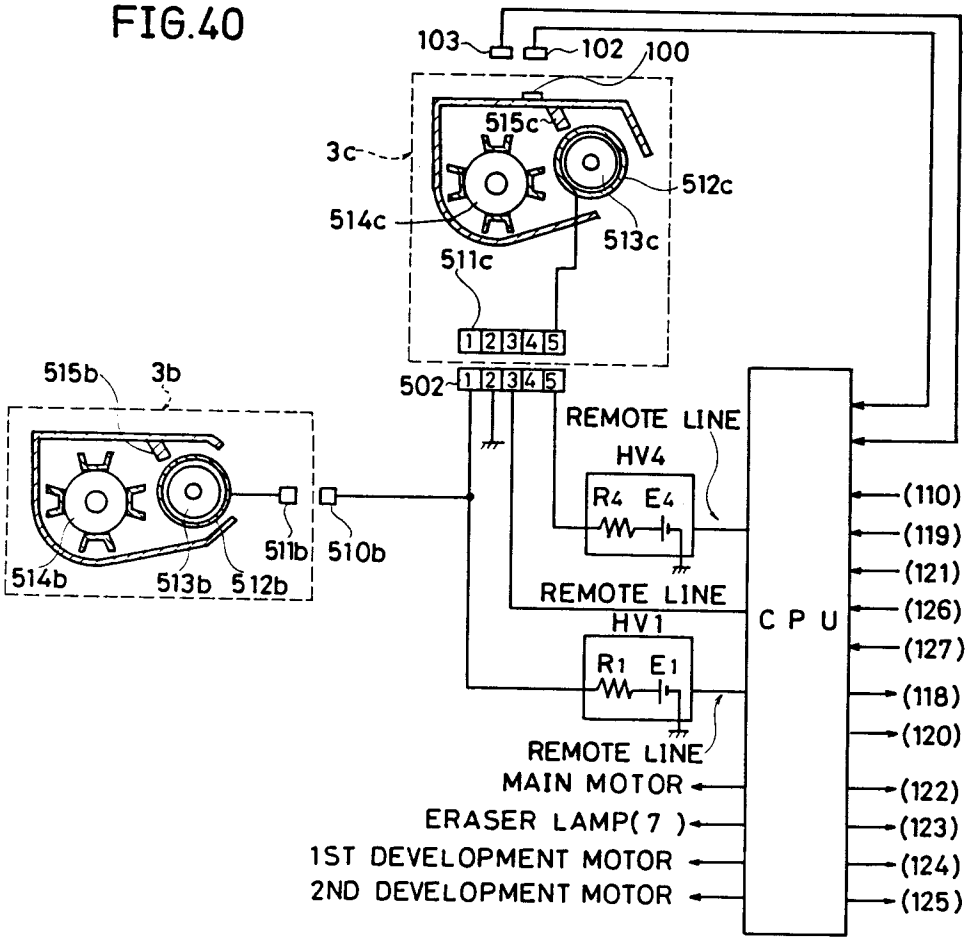
FIGS. 40 and 41 are circuit diagrams of the main body of the copying apparatus of the fourth embodiment and a circuit diagram showing connections in the case of mounting one of the developing devices and the outline image forming unit, respectively, different voltages being applied to the first and second developing devices.
Figure 41:
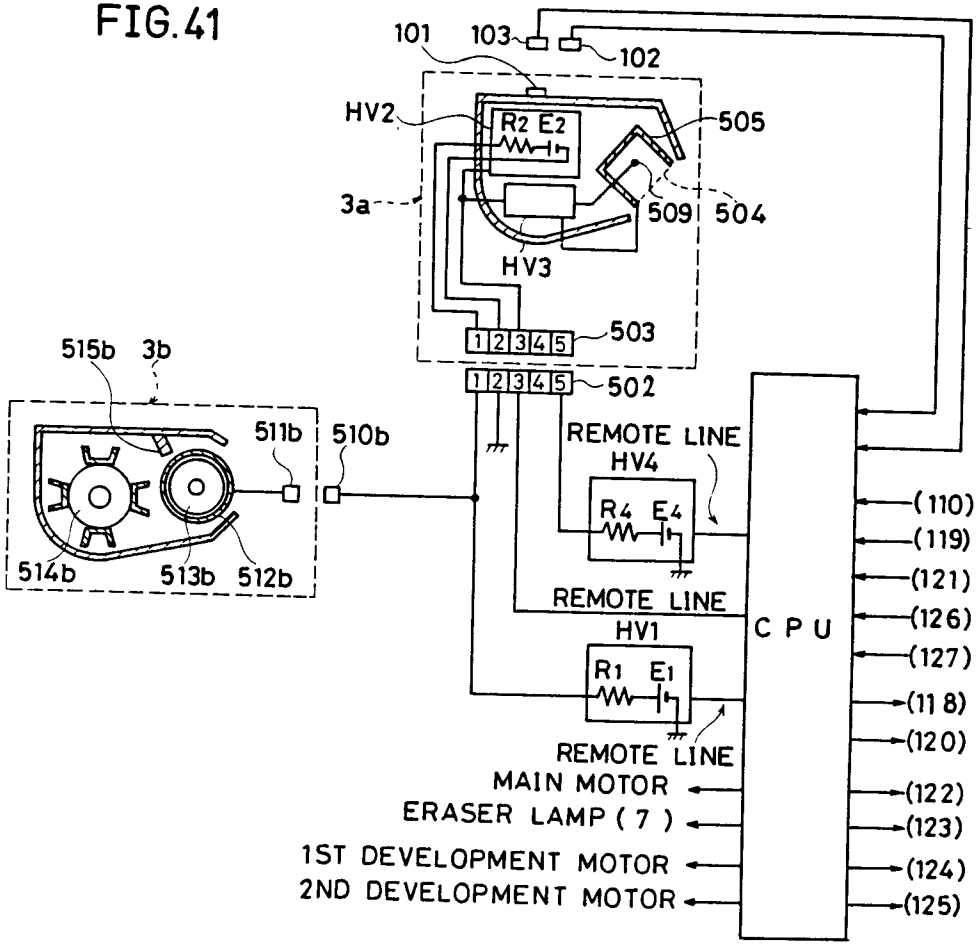

On the other hand, the second developing device 3*b* has connector 511*b* connected to the developer sleeve 512*b* as shown in FIGS. 40 and 41.

Figure 39:
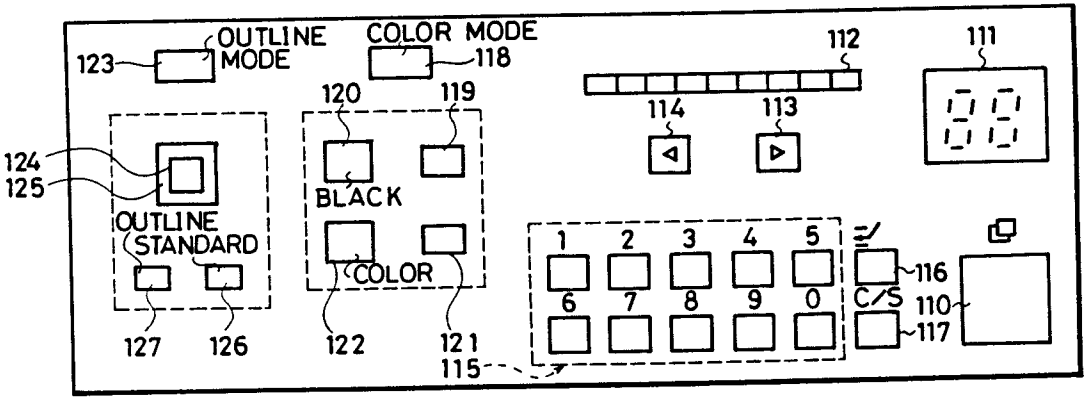
FIG. 39 is a plan view of an operation panel in the fourth embodiment.

Referring now to FIG. 39, various keys and display elements on the operation panel of this embodiment will be described.

The operation panel comprises a print key 110 for instructing a start of copy operation, a display panel 111 for indicating the number of copies and the like, an up key 113 and a down key 114 for regulation of image density, and a display LED array 112. The image density is regulated by increasing or decreasing an amount of light of the exposure lamp 10. The operation panel further comprises a ten key group 115 including keys 1 to 9 and 0, and an interruption key 116 for instructing interruption, and a clear stop key 117 for temporarily stopping continuous copy operation and resetting the display of the panel 111 to 1.

An LED element 118 indicates a color mode. It is turned on when the first developing device 3*c* is mounted, thereby to indicate that the standard copy in black or color can be made. A key 119 serves to operate the second developing device 3*b* to select copy in black. When the key 119 is operated, a display LED 120 is turned on. A key 121 serves to operate the first developing device 3*c* to select the color mode. When the key 121 is operated, a display LED 122 is turned on.

An LED 123 indicates an outline image forming mode. It is turned on when the outline image forming unit 3*a* is mounted in place of the first developing device 3*c*, thereby to indicate that outlines of an original image can be copied. A key 126 serves to select the standard copy mode. When the key 126 is operated, an LED 124 is turned on. A key 127 serves to select the outline image forming mode. When the key 127 is operated, an LED 125 is turned on.

Even if the outline image forming unit 3*a* is mounted, when copy operation is performed with the scorotron charger 505 being turned off, an image corresponding to an original image with a 1:1 relation can be formed. The selection key 126 is used to select standard copy in such state.

Now connections in the main body of the copying apparatus will be described referring to FIGS. 40 and 41.

FIGS. 40 and 41 show a control circuit of the copying apparatus. FIG. 40 corresponds to the case in which the first developing device 3*c* is mounted and FIG. 41 corresponds to the case in which the outline image forming unit 3*a* is mounted in place thereof.

The main body of the copying apparatus contains a CPU, which serves as the center for performing control operation. More specifically, the CPU receives on or off signals of the selection keys 119, 121, 126 and 127, and the like and it outputs on or off signals to the display LEDs 118, 120, 122, to 125 and the like. In addition, the CPU outputs on or off signals to the main motor of the main body of the copying apparatus, the eraser lamp 7, the first and second development motors and the like.

The main body of the copying apparatus includes connecters 502 and 510*b* and power supplies HV1 and HV4. The connector 502 corresponds to the above mentioned connectors 503 and 511*c* and has five pins which are connected as follows.

First pin: to an output terminal of the power supply HV1 and the connector 510*b*

Second pin: grounded

Third pin: to a remote terminal of the CPU

Fifth pin: to an output terminal of the power supply HV4.

The power supplies HV1 and HV4 have eleetromotive forces E1 of +150 V and E4 of +180 V, and resistances R1 and R4, respectively. Particularly, the resistance R1 has the same resistance value as that of the resistance R2 of the power supply HV2 for the outline image forming unit 3*a*. The power supplies HV1 and HV4 are connected to remote terminals of the CPU, so that the outputs thereof are turned on and off in response to signals from the CPU.

When the outline image forming unit 3*a* or the first developing device 3*c* is mounted in the main body of the copying apparatus, the connector 503 or 511*c* is automatically coupled with the connector 502 in the main body of the copying apparatus. When the second developing device 3*b* is mounted in the main body on the copying apparatus, the connector 511*b* is automatically coupled with the connector 510*b* in the main body In the following, operation of the thus constructed copying apparatus will be described.

First, if the developing devices 3*c* and 3*b* are mounted as shown in FIG. 34, the developer sleeve 512*c* of the first developing device 3*c* is connected with the power supply HV4 through the respective fifth pins of the connectors 502 and 511*c*, and the developer sleeve 512*b* of the second developing device 3*b* is connected with the power supply HV1 through the connectors 510*b* and 511*b*, as shown in FIG. 40. Thus, the developer sleeves 512*c* and 512*b* are ready to be charged with development bias voltages Vb of +180 V and +150 V, respectively.

The magnet 100 turns on the switch 102 and the CPU determines that the first developing device 3*c* having color developer is mounted, whereby the color mode display LED 118 is turned on.

Thus, the copying apparatus is set to a state ready for standard copy. When the black selection key 119 or the color selection key 121 is turned on, the black display LED 120 or the color display LED 122 is illuminated on the operation panel.

Then, if the print key 110 is turned on, the CPU outputs a signal to the power supply HV1 or HV4 to apply the developing bias voltage Vb of +150 V to the developer sleeve 512*b* is black printing is selected or to apply the development bias voltage Vb of +180 V to the developer sleeve 512*c* if color printing is selected.

After a lapse of a predetermined period, the photoreceptor drum 2 is driven to be rotated in the direction of the arrow a and the respective devices are operated, so that copy operation is performed.

More specifically, electric charge of +600 V is uniformly applied to the surface of the photoreceptor drum 2 by discharge of the corona charger 6 and then the photoreceptor drum 2 is subjected to exposure of an original image by the exposure device 1, whereby an electrostatic latent image corresponding thereto is formed. The electrostatic latent image is caused to be visible when it receives toner in a region facing the developing device 3*c* or 3*b* based on a difference between the development bias voltage Vb and a surface potential of the electrostatic latent image area. Thus, a toner image corresponding to the original image is formed.

On the other hand, copy paper sheets are stored in the automatic feed cassette 130. The copy paper sheets in the automatic cassette 130 are fed one by one starting from the upper most sheet, by means of the feed roller 131, so as to be transported between the photoreceptor drum 2 and the transfer charger 5*a* by means of the timing rollers 132 with timing corresponding to the toner image. The toner image is transferred to the copy paper sheet and it is separated from the photoreceptor drum 2 by means of the separation claw 5*b* and sent to the fixing device 134 through the guide plate 133. The toner is fixed by the fixing device 134 and after that the copy paper sheet is discharged on the tray 135.

If the outline image forming unit 3*a* is mounted in place of the first developing device 3*c* as shown in FIG. 41, the switch 103 is turned on and the CPU determines that the unit 3*a* is mounted, whereby the outline image mode display LED 123 on the operation panel is illuminated.

Subsequently, when the outline image forming mode selection key 127 is turned on, the outline image mode selection display LED 125 on the operation panel is illuminated.

If the print key 110 is turned on in the above described state, the CPU receives the on signal to operate the power supply HV1. As a result, electric power is supplied from the power supply HV1 to the developer sleeve 512*b* and the development bias voltage Vb is set to +150 V at first.

After a predetermined period has passed from the turn-on of the print key 110, the main motor is turned on to start rotation of the photoreceptor drum 2 in the direction of the arrow a. Then, the CPU operates the power supplies HV2 and HV3 of the unit 3*a*.

Thus, the developer sleeve 512*b* newly receives electric power from the power supply HV1 and output voltages of the power supplies HV1 and HV2 are synthesized with the resistances R1 and R2 being set to the same resistance value. Consequently, the developing bias voltage Vb of the developer sleeve 512*b* is set to +200 V.

Predetermined voltages are applied from the power supply HV3 to the charge wire 509 and the grid 504 of the scorotron charger 505.

As shown in FIGS. 2 and 3, in the case of forming a positive outline image by exposure of a positive original image, a voltage having a polarity opposite to that of the voltage applied to the corona charger 6 is applied to the charge wire 509.

A voltage having the same polarity as that of the voltage applied to the corona charger 6 is applied to the grid 504. The voltage applied to the grid 504 is sufficiently lower than the surface potential of the electrostatic latent image area and slightly higher than the surface potential of the non-image area.

In the thus set state, the same copy operation as described above is performed.

The surface of the photoreceptor drum 2 is uniformly charged at +600 V by the corona charger 6 and then the photoreceptor drum 2 is subjected to exposure of an original image by the exposure device 1, whereby electrostatic latent images A0 and B0 as shown in FIG. 33A are formed.

Subsequently, a voltage is applied from the scorotron charger 505 of the outline image forming unit 3a, whereby the electrostatic latent images are changed as shown in FIG. 33B. More specifically, as for the image area A, only outline portions Ao' are picked up and as for the line image B, the electrostatic latent image Bo' almost unchanged is formed.

Then, toner is supplied to the outlines Ao' and the electrostatic latent image Bo' in a region facing the second developing device 3b. Since the grid voltage Vg is set to +200 V which is higher than the development bias voltage Vb (+150 V) by +50 V, toner is not supplied to the surrounding portions of the outlines Ao' and thus a sharp toner image is formed.

Subsequently, the toner image is transferred onto the copy paper sheet in a region of the drum facing the transfer charger 5a and the transferred toner image is thermally fixed by the fixing rollers 134, whereby the copy paper sheet is discharged on the discharge tray 135.

Thus, a copy image as shown in FIG. 3 is obtained if the original image is as shown in FIG. 2. More specifically, the solid image A is reproduced as the outline image A' and the line image B is reproduced as the unchanged line image B' on the copy paper.

Even if the outline image forming unit 3a is mounted, when the standard copy mode selection key 126 is turned on, signals are outputted from the CPU to the power supplies HV2 and HV3 through the respective remote terminals thereof to stop the outline image forming unit 3a. Thus, only the second developing device 3b is operated so that the standard copy operation is performed.

Figure 42:
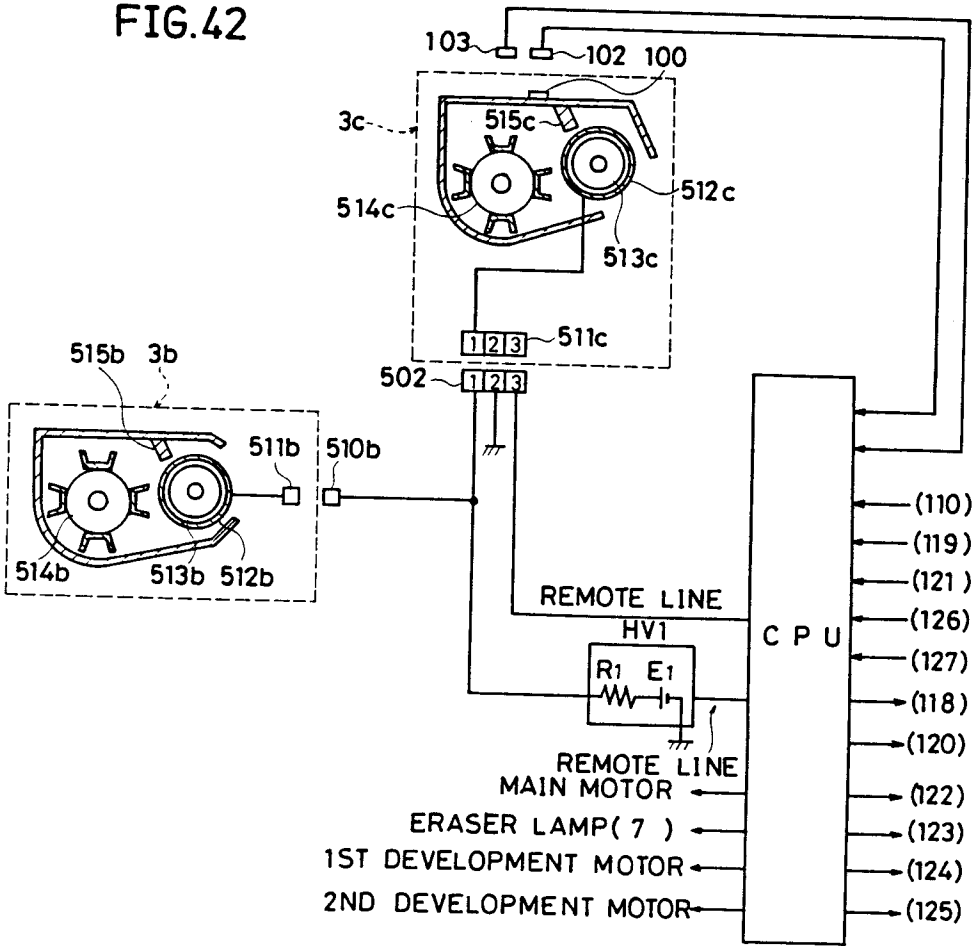
FIGS. 42 and 43 are circuit diagrams in the case in which the same developing bias voltage is applied to the first and second developing devices.
Figure 43:
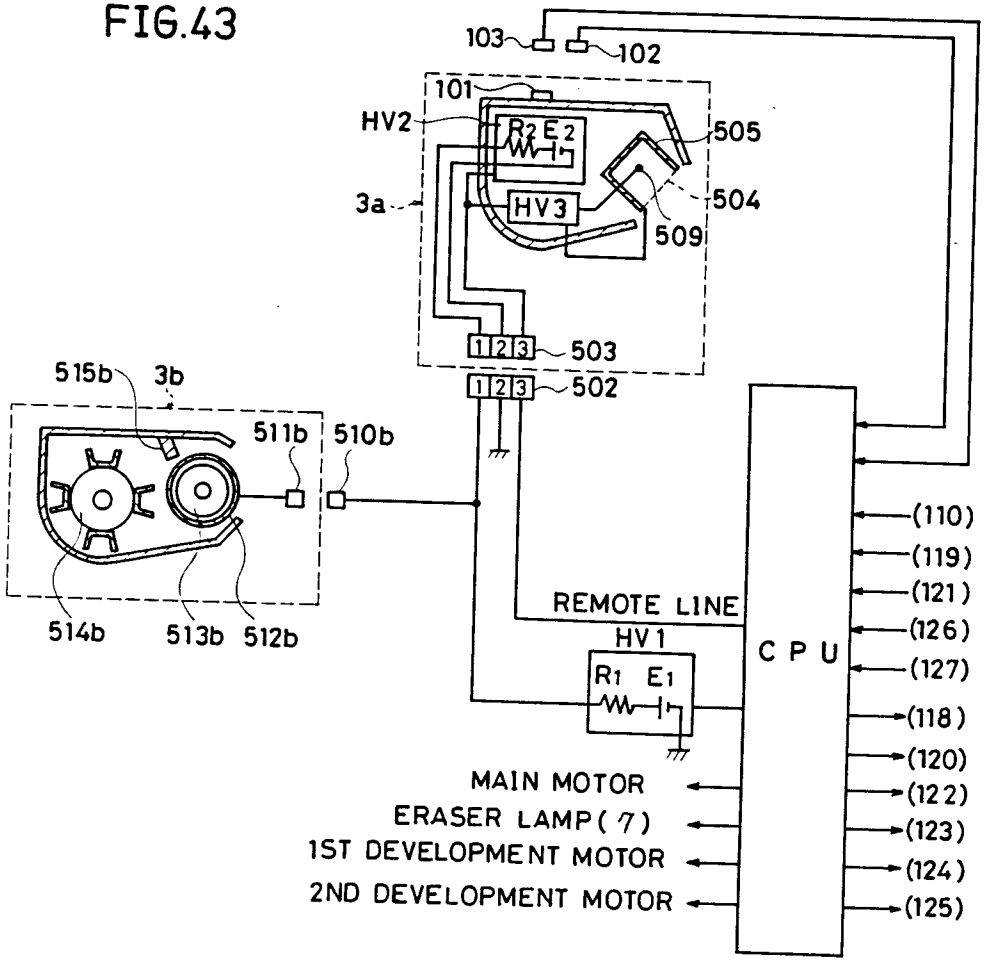

Although in the above described embodiment the development bias voltage of +180 V is applied to the developer sleeve 512c of the first color developing device 3c and the development bias voltage of +150 V is applied to the developer sleeve 512b of the second black developing device 3b, a development bias voltage of +150 V may be applied to both of the developer sleeves 512c and 512b. In such a case, as shown in FIGS. 42 and 43, only the power supply HV1 may be provided in the main body of the copying apparatus. Thus, in the standard copy mode, the same voltage may be applied from the power supply HV1 to the developing device 3c or 3b, while in the outline image forming mode, a synthesized voltage of +200 V of the voltage of the power supply HV1 in the main body and the voltage of the power supply HV2 in the unit 3a may be supplied.

Figure 44:
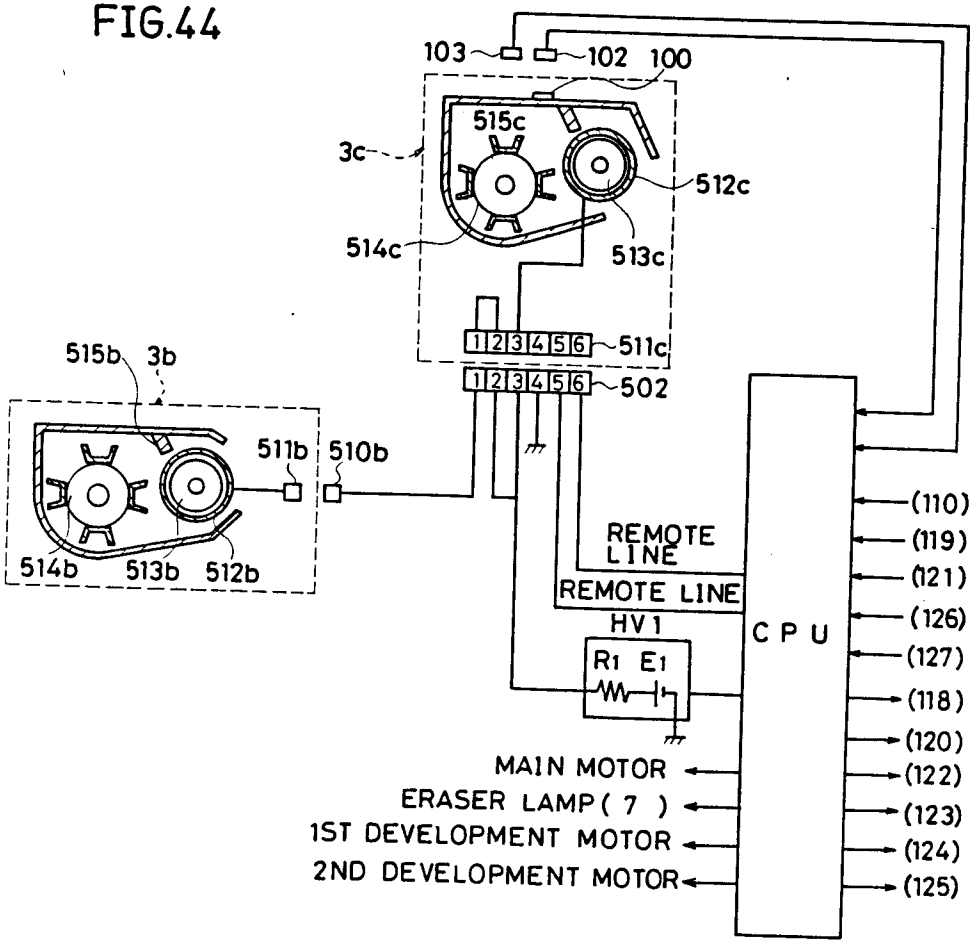
FIGS. 44 and 45 are circuit diagrams of another construction in which the same developing bias voltage is applied to the first and second developing devices.
Figure 45:
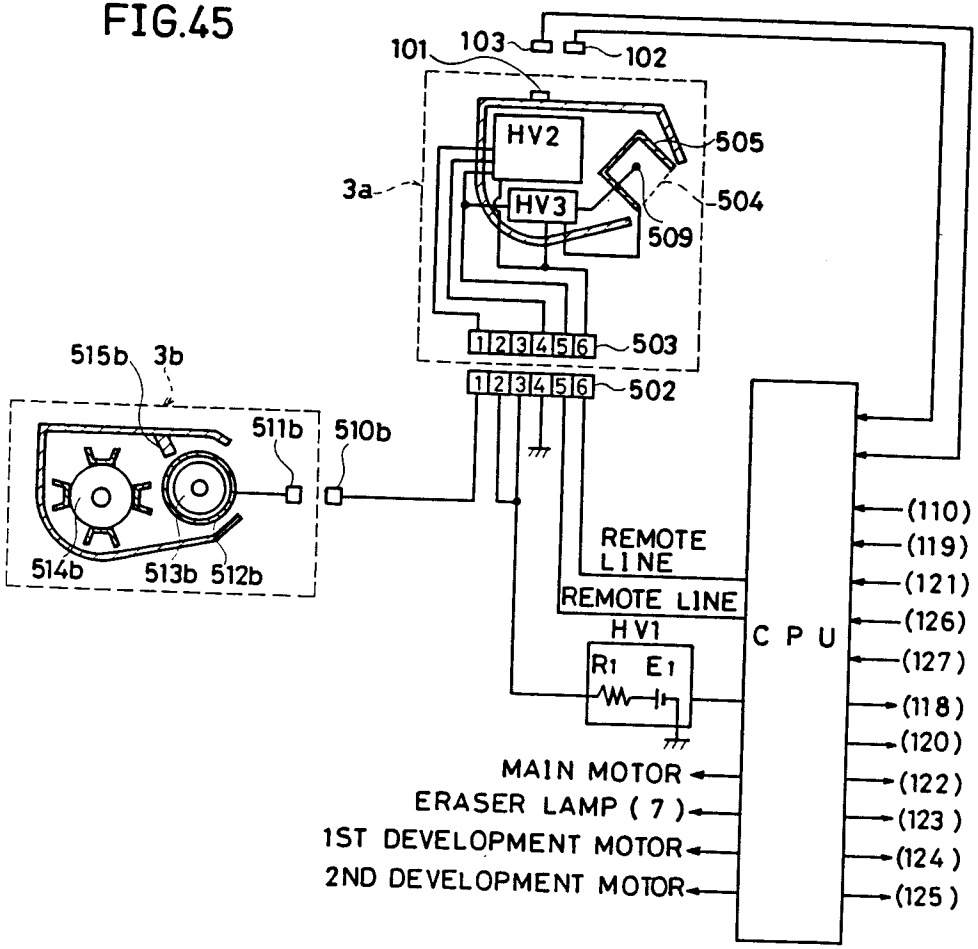

In addition, as shown in FIGS. 44 and 45, the power supply HV1 of the main body needs not be directly connected to the second developing device 3b. In such a case, the same voltage may be set to be applied from the power supply HV1 to the developing devices 3c and 3b when the first developing device 3c is mounted. When the outline image forming unit 3a is mounted in place thereof, a voltage may be applied from the power supply HV2 in the unit 3a to the second developing device 3b.

In that case,a power supply having an output enabling switching between +150 V and +200 V is used as the power supply HV2 in the unit 3a and the power supplies HV2 and HV3 are connected with the CPU through two remote lines, thereby to select outputs of the power supplies HV2 and HV3 dependent on four states set by combination of 0 and 1 of the two remote lines. If the outline image forming mode is not selected even in the state in which the unit 3a is mounted, the output of the power supply HV2 is set to +150 V and the output of the power supply HV3 is set to 0 V.

In addition, the power supplies HV2 and HV3 may be connected with the CPU through individual remote lines, so that the power supplies HV2 and HV3 are controlled individually. In this case, the outline image forming mode and the standard image forming mode can be switched with each other during one copy cycle by control of the CPU of the main body and thus finer control can be made.

Figure 33D:
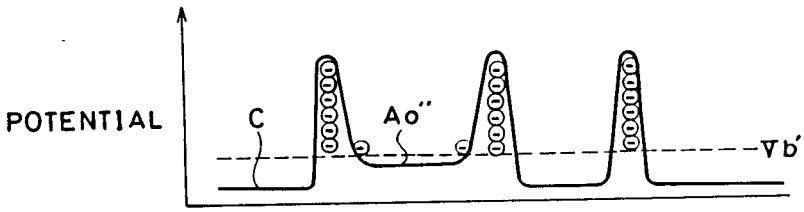

In addition, if the voltage applied to the grid 504 is changed, the area of Ao" as shown in FIG. 33D can be changed. In this manner, the density in the area excluding the outlines of the face image can be controlled in the outline image forming mode.

Furthermore, although both of the developing devices 3c and 3b are demountable in this fourth embodiment, the second developing device 3b and other developing devices downstream thereof may be fixed as far as the first developing device 3c is demountable.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus capable of compositing an outline image and a normal image, comprising:

an electrostatic latent image bearing member having a surface and provided in a rotatable manner, first charging means for charging the surface of said electrostatic latent image bearing member, exposure means for exposing the surface of said electrostatic latent image bearing member charged by said first charging means to an original image, thereby to form an electrostatic latent image thereon, second charging means for recharging the electrostatic latent image formed on said electrostatic latent image bearing member by said exposure means, to cause a potential in areas other than outline portions of the electrostatic latent image to be substantially equal to a potential of a non-image area, thereby to form an electrostatic latent image of only the outline portions, developing means for developing the electrostatic latent image formed on said electrostatic latent image bearing member, transfer means for transferring the image developed be said developing means, first control means for controlling operation of said first charging means, said exposure means, said developing means and said transfer means to form a first image, second control means for controlling operation of said first charging means, said exposure means, said second charging means, said developing means and said transfer means to form a second image, said second image being an outline obtained by making visible only the outline portions of the original image, and third control means for control to copy, on the same surface of copy paper, the first image formed by the control of said first control means and the second image formed by the control of said second control means.

2. A copying apparatus in accordance with claim 1, further comprising refeed means for storing a sheet of copy paper having one face where the first or second image has been formed and refeeding said copy paper to said transfer means.

3. A copying apparatus in accordance with claim 2, wherein said third control means controls said refeed means to refeed the copy paper having one face where the first image has been formed to said transfer means and controls said second control means to form the second image on said face of the copy paper refed by said refeed means.

4. A copying apparatus in accordance with claim 2, wherein said third control means controls said refeed means to refeed the copy paper having one face where the second image has been formed to said transfer means and controls said first control means to form the first image on said face of the copy paper refed by said refeed means.

5. A copying apparatus capable of compositing an outline image and a normal image, comprising:

an electrostatic latent image bearing member having a surface and provided in a rotatable manner, first charging means for charging the surface of said electrostatic latent image bearing member, exposure means for exposing said electrostatic latent image bearing member charged by said first charging means to an original image, thereby to form an electrostatic latent image thereon, second charging means for recharging the electrostatic latent image formed on said electrostatic latent image bearing member by said exposure means, causing a potential of areas other than outline portions of the electrostatic latent image to be substantially equal to a potential of a non-image area, thereby to form an electrostatic latent image of only the outline portions.

developing means for developing the electrostatic latent image formed on said electrostatic latent image bearing member, transfer means for transferring the image developed by said developing means, first control means for controlling operation of said first charging means, said exposure means, said developing means and said transfer means to form a first image, and second control means for controlling operation of said first charging means, said exposure means, said developing means and said transfer means to form a second image, at least either said first control means or said second control means further controlling operation of said second charging means, to form an electrostatic latent image of only the outline portions of the original image, whereby an outline image of only the outline portions is formed, said copying apparatus further comprising, refeed unit means for storing copy paper having one face where the image has been formed and refeeding the copy paper to said transfer means, and third control means for controlling said refeed unit means to store the copy paper having one face where the first image has been formed by the control of said first control means and to refeed the copy paper to said transfer means, and controlling said second control means to form the second image on said face of the copy paper refed by said refeed unit means, on which the first image has been formed.

6. A copying apparatus in accordance with claim 5, further comprising area designation means for designating an area of the original image.

7. A copying apparatus in accordance with claim 6, wherein said second control means controls operation of said second charging means as well as operation of said first charging means, said exposure means, said developing means and said transfer means to form an electrostatic latent image of only the outline portions of the original image, whereby only the outline portions are caused to be visible to form an outline image.

8. A copying apparatus in accordance with claim 7, wherein said second control means exerts control to form the second image only inside the area designated by said area designation means.

9. A copying apparatus in accordance with claim 7, wherein said second control means exerts control to form the second image only outside the area designated by said area designation means.

10. A copying apparatus capable of compositing an outline image and a normal image, comprising:

an electrostatic latent image bearing member having a surface and provided in a rotatable manner, first charging means for charging the surface of said electrostatic latent image bearing member, exposure means for exposing said electrostatic latent image bearing member charged by said first charging means to an original image, thereby to form an electrostatic latent image thereon, second charging means for recharging the electrostatic latent image formed on said electrostatic latent image bearing member by said exposure means, causing a potential in areas other than outline portions of the electrostatic latent image to be substantially equal to a potential of a non-image area, thereby to form an electrostatic latent image of only the outline portions, developing means for developing the electrostatic latent image formed on said electrostatic latent image bearing member, transfer means for transferring the image developed by said developing means, refeed unit means for storing copy paper having one face where the image has been formed and refeeding the copy paper to said transfer means, area designation means for designating an area of the original image, mode designation means for designating an outline image forming mode for operating said second charging means as well as said first charging means, said exposure means, said developing means and said transfer means, to cause only the outline portions of the original image to be a visible image, and control means responsive to designation of the outline image forming mode by said mode designation means and designation of the area by said area designation means for controlling a first copy operation to copy the image outside the designated area on copy paper by said first charging means, said exposure means, said developing means and said transfer means, to store said copy paper in said refeed unit means and to refeed said copy paper to said transfer means, and controlling a second copy operation by said first charging means, said exposure means, said second charging means, said developing means and said transfer means to cause only outline portions of an image inside the designated area to be a visible image and to copy the same on the face where the image outside the designated area has been formed.

11. A copying apparatus in accordance with claim 10, further comprising erasure means for erasing electric charge on said electrostatic latent image bearing member.

12. A copying apparatus in accordance with claim 11, wherein said control means controls said erasure means in the first copy operation to erase electric charge inside the area designated by said area designation means, out of the electric charge applied on said electrostatic latent image bearing member, whereby only the image outside the designated area is copied.

13. A copying apparatus in accordance with claim 11, wherein said control means controls the second copy operation to erase electric charge outside the area designated by said area designation means, out of the electric charge applied on said latent image bearing member, whereby only the image inside the designated area is copied.

14. A copying apparatus in accordance with claim 10, wherein said developing means at least has a first developing device, and a second developing device located downstream of said first developing device along a rotating direction of said electrostatic latent image bearing member, and said developing means further comprises a power supply for applying predetermined voltages to said first and second developing devices.

15. A copying apparatus in accordance with claim 10, wherein said developing means comprises at least a first developing device for storing first developer, and a second developing device for storing second developer of a color different from that of the first developer, and said control means exerts control to cause the image inside the area designated by said area designation means and the image outside the designated area to be visible in different colors.

16. A copying apparatus in accordance with claim 14, wherein said second charging means comprises a scorotron charger having a grid, and a second power supply for applying a voltage to said scorotron charger and said grid, said second charging means being able to be mounted in place of said first developing device.

17. A copying apparatus in accordance with claim 16, wherein if said second charging means is mounted in place of said first developing device, a predetermined voltage is applied to said second developing device by cooperation of said power supply and a further power supply, said predetermined voltage being higher than the voltage applied from said power supply to said first developing device and lower than the voltage applied from said further power supply to said scorotron charger and said grid.

18. A copying apparatus capable of compositing an outline image and a normal image, comprising:

an electrostatic latent image bearing member having a surface and provided in a rotatable manner, first charging means for charging the surface of said electrostatic latent image bearing member, exposure means for exposing said electrostatic latent image bearing member charged by said first charging means to an original image, thereby to form an electrostatic latent image thereon, second charging means for recharging the electrostatic latent image formed on said electrostatic latent image bearing member by said exposure means, causing a potential in areas other than outline portions of the electrostatic latent image to be substantially equal to a potential of a non-image area, thereby to form an electrostatic latent image of only the outline portions, developing means for developing the electrostatic latent image formed on said electrostatic latent image bearing member, transfer means for transferring the image developed by said developing means, erasure means for erasing electric charge applied on said electrostatic latent image bearing member, refeed unit means for storing copy paper having one face where the image has been formed and refeeding the copy paper to said transfer means, area designation means for designating an area of the original image, first control means for controlling operation of said first charging means, said exposure means, said second charging means, said developing means and said transfer means to form the electrostatic latent image of only the outline portions and to cause said image to be visible, whereby a first image is formed, second control means for controlling operation of said first charging means, said exposure means, said erasure means, said developing means and said transfer means to erase electric charge in a portion of said electrostatic latent image bearing member, corresponding to the original image in the area designated by said area designation means, out of the electric charge applied on said electrostatic latent image bearing member, thereby to from a second image, and third control means for controlling said refeed unit means to form, on the same face of copy paper, the first image formed by the control of said first control means and the second image formed by the control of said second control means.

19. A copying apparatus in accordance with claim 18, wherein said second control means exerts control to erase only electric charge outside the area designated by said area designation means, out of the electric charge applied on said electrostatic latent image bearing member, to cause only the image inside the designated area to be visible, whereby the second image is formed.

20. A copying apparatus in accordance with claim 19, wherein said first control means exerts control to form the first image for only the image outside the area designated by said area designation means.

21. A copying apparatus in accordance with claim 20, wherein said third control means controls said refeed unit means to store the copy paper on which the second image has been formed by the control of said second control means, in said refeed unit means and to refeed the copy paper to said transfer means and controls said first control means to form the first image on the face of the copy paper refed by said refeed unit means, on which the second image has been formed.

22. A copying apparatus in accordance with claim 18, wherein said second control means exerts control to erase only electric charge inside the area designated by said area designation means to cause only the image outside the designated area to be visible, whereby the second image is formed.

23. A copy apparatus in accordance with claim 22, wherein said first control means exerts control to form the first image for only the image inside the area designated by said area designation means.

24. A copying apparatus in accordance with claim 23, wherein said third control means controls said refeed unit means to store the copy paper on which the second image has been formed by the control of said second control means, in said refeed unit means and to refeed said copy paper to said transfer means and controls said first control means to form the first image on the face of the copy paper refed by said refeed means, on which the second image has been formed.

25. A copying apparatus capable of copying an outline image and a normal image, comprising:

an electrostatic latent image bearing member having a surface and provided in a rotatable means, first charging means for charging the surface of said electrostatic latent image bearing member, exposure means for exposing said electrostatic latent image bearing member charged by said charging means to an original image, thereby to form an electrostatic image thereon, second charging means for recharging the electrostatic latent image formed on said electrostatic latent image bearing member by said exposure means, causing a potential in areas other than outline portions of the electrostatic latent image to be substantially equal to a potential of a non-image area, thereby to form an electrostatic latent image of only the outline portions, developing means for developing the electrostatic latent image formed on said electrostatic latent image bearing member, transfer means for transferring the image developed by said developing means, refeed unit means for storing copy paper having one face where the image has been formed and refeeding the copy paper to said transfer means, area designation means for designating an area of the original image, mode designation means for designating an outline image forming mode for operating said second charging means as well as said first charging means, said exposure means, said developing means and said transfer means to cause only the outline portions of the original image to be a visible image, and control means responsive to designation of the outline image forming mode by said mode designation means and designation of the area by said area designation means for controlling a first copy operation to cause only the outline portions of the image inside the designated area to be a visible image on the copy paper by using said first charging means, said exposure means, said second charging means, said developing means and said transfer means, to store said copy paper in said refeed unit means and to refeed said copy paper to said transfer means, and controlling a second copy operation to form the image outside the designated area on the face on which the image inside the designated area has been formed, by using said first charging means, said exposure means, said developing means and said transfer means.

26. A copying apparatus in accordance with claim 25, further comprising erasure means for erasing electric charge applied on said electrostatic latent image bearing member.

27. A copying apparatus in accordance with claim 26, wherein said control means controls said erasure means in the first copy operation to erase electric charge outside the area designated by said area designation means, out of the electric charge applied on said electrostatic latent image bearing member, whereby only the image inside the designated area is copied.

28. A copying apparatus in accordance with claim 26, wherein said control means controls said erasure means in the second copy operation to erase electric charge inside the area designated by said area designation means, out of the electric charge applied on said electrostatic latent image bearing member, thereby to copy only the image outside the designated area.

29. A copying apparatus in accordance with claim 25, wherein said developing means comprises at least a first device for storing first developer, and a second developing device for storing second developer of a color different from that of the first developer, and said control means exerts control to cause the image inside the area designated by said area designation means and the image outside the designated area to be visible images in different colors.

30. A copying apparatus in accordance with claim 25, wherein said developing means comprises at least a first developing device and a second developing device located downstream of said first developing device along a rotating direction of said electrostatic latent image bearing member, and said developing means further comprises a power supply for applying predetermined voltages to said first and second developing devices.

31. A copying apparatus in accordance with claim 30, wherein said second charging means comprises a scorotron charger having a grid, and a second power supply for applying a voltage to said scorotron charger and said grid, said second charging means being able to be mounted in place of said first developing device.

32. A copying apparatus in accordance with claim 30, wherein if said second charging means is mounted in place of said first developing device, a predetermined voltage is applied to said second developing device by cooperation of said power supply and a further power supply, said predetermined voltage being higher than the voltage applied from said power supply to said first developing device and lower than the voltage applied from said further power supply to said scorotron charger and said grid.

33. A copying apparatus capable of compositing an outline image and a normal image, comprising:

an electrostatic latent image bearing member having a surface and provided in a rotatable manner, first charging means for charging the surface of said electrostatic latent image bearing member, exposure means for exposing said electrostatic latent image bearing member charged by said first charging means to an original image, thereby to form an electrostatic latent image thereon, second charging means for recharging the electrostatic latent image formed on the surface of said electrostatic latent image bearing member by said exposure means, developing means for developing the electrostatic latent image formed on said electrostatic latent image bearing member, transfer means for transferring the image developed by said developing means, area designation means for designating an area of the original image, first mode designation means for designating an outline image forming mode for causing only outline portions of the original image to be a visible image, erasure means for erasing electric charge applied on said electrostatic latent image bearing member, second mode designation means for designating a trimming mode for causing only the image inside the area designated by said area designation means to be a visible image, and control means responsive to designation of the outline image forming mode by said first mode designation means and designation of the trimming mode by said second mode designation means for controlling one copy operation in which:

said first charging means is operated to charge said electrostatic latent image bearing member; said erasure means is operated to erase electric charge outside the designated area, out of the electric charge applied on said electrostatic latent image bearing member; said exposure means is operated to expose said electrostatic latent image bearing member to the original image to form an electrostatic latent image thereon corresponding to the image inside the designated area; said second charging means is operated to recharge the electrostatic latent image formed by said exposure means, causing a potential in areas other than outline portions of the electrostatic latent image to be substantially equal to a potential of a non-image area, thereby to form an electrostatic latent image of the outline portions; said developing means are operated to cause the electrostatic latent image recharged by said second charging means to be a visible image; and said transfer means is operated to cause said visible image to be transferred onto the copy paper.

34. A copying apparatus capable of compositing an outline image and a normal image, comprising:

an electrostatic latent image bearing member having a surface and provided in a rotatable manner, first charging means for charging the surface of said electrostatic latent image bearing member, exposure means for exposing said electrostatic latent image bearing member charged by said first charging means to an original image, thereby to form an electrostatic latent image thereon, second charging means for recharging the electrostatic latent image formed on said electrostatic latent image bearing member by said exposure means, developing means for developing the electrostatic latent image formed on said electrostatic latent image bearing member, transfer means for transferring the image developed by said developing means, area designation means for designating an area of the original image, first mode designation means for designating an outline image forming mode for causing only outline portions of the original image to be a visible image, erasure means for erasing the electric charge applied on said electrostatic latent image bearing member, second mode designation means for designating an erase mode for causing only the image outside the area designated by said area designation means to be a visible image, and control means responsive to designation of the outline image forming mode by said first mode designation means and designation of the erase mode by said second mode designation means for controlling one copy operation in which:

said first charging means is operated to charge said electrostatic latent image bearing member; said erasure means is operated to erase electric charge inside the designated area, out of the electric charge applied on said electrostatic latent image bearing member; said exposure means is operated to expose said electrostatic latent image bearing member to the original image, thereby to form an electrostatic latent image corresponding to the image outside the designated area; said second charging means is operated to recharge the electrostatic latent image formed by said exposure means, causing a potential in areas other than outline portions of the electrostatic latent image to be substantially equal to a potential of a non-image area, thereby to form an electrostatic latent image of only the outline portions; said developing means is operated to cause the electrostatic latent image recharged by said second charging means to be a visible image; and said transfer means is operated to transfer the visible image on the copy paper.

* * * * *